US008199093B2

(12) United States Patent
Song et al.

(10) Patent No.: US 8,199,093 B2
(45) Date of Patent: Jun. 12, 2012

(54) LIQUID CRYSTAL DISPLAY AND METHOD OF DRIVING THE SAME

(75) Inventors: Hongsung Song, Gumsi-si (KR); Woongki Min, Daegu (KR); Yonggi Son, Milyang-si (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 743 days.

(21) Appl. No.: 12/318,316

(22) Filed: Dec. 24, 2008

(65) Prior Publication Data

US 2009/0273555 A1 Nov. 5, 2009

(30) Foreign Application Priority Data

Apr. 30, 2008 (KR) ..... 10-2008-0040460

(51) Int. Cl.
*G09G 3/36* (2006.01)

(52) U.S. Cl. ..... 345/96; 345/99

(58) Field of Classification Search ..... 345/204, 345/690, 87–89, 94–96, 98–100, 208–210
See application file for complete search history.

(56) References Cited

U.S. PATENT DOCUMENTS

2008/0238897 A1* 10/2008 Kimura ..... 345/204
2009/0115772 A1* 5/2009 Shiomi et al. ..... 345/214

* cited by examiner

*Primary Examiner* — Ricardo L Osorio
(74) *Attorney, Agent, or Firm* — McKenna, Long and Aldridge, LLP.

(57) ABSTRACT

A liquid crystal display and a method of driving the same are disclosed. The liquid crystal display includes a timing signal multiplying circuit multiplying a frequency of a timing signal, a timing control signal generating circuit generating a polarity control signal based on the multiplied timing signal, a polarity control signal inverting circuit that inverts the polarity control signal in response to an inverse periodic signal, that is inverted every constant time interval, to generate an inverse polarity control signal, and a data drive circuit that respectively converts digital video data and digital black data into a video data voltage and a black gray level voltage, inverts polarities of the video data voltage and the black gray level voltage in response to the inverse polarity control signal, and supplies the video data voltage and the black gray level voltage to data lines.

7 Claims, 19 Drawing Sheets

LIQUID CRYSTAL DISPLAY AND METHOD OF DRIVING THE SAME

This application claims the benefit of Korea Patent Application No. 10-2008-0040460 filed on Apr. 30, 2008, which is incorporated herein by reference for all purposes as if fully set forth herein.

BACKGROUND OF THE INVENTION

1. Field of the Invention

Exemplary embodiments relate to a liquid crystal display and a method of driving the same.

2. Discussion of the Related Art

Active matrix type liquid crystal displays display a moving picture using a thin film transistor (TFT) as a switching element. The active matrix type liquid crystal displays have been implemented televisions as well as display devices in portable devices, such as office equipment and computers, because of the thin profile of the active matrix type liquid crystal displays. Accordingly, cathode ray tubes (CRT) are being rapidly replaced by the active matrix type liquid crystal displays.

If a DC voltage is applied to a liquid crystal layer of a liquid crystal display for a long time, ions in the liquid crystal layer are polarized depending on polarities of liquid crystals. Further, as time elapsed, the amount of ions accumulated in the liquid crystal layer increases. An increase in the amount of accumulated ions degrades an alignment layer and alignment characteristics of the liquid crystals. In other words, the application of the DC voltage to the liquid crystal layer for a long time causes stains on the display screen, and the size of the stains increases as time elapsed. To solve the stain problem, a liquid crystal material with a low dielectric constant has been developed, or a method for improving an alignment material or an alignment method has been attempted. However, it takes a long time and a heavy expense to develop a material used in the method. Further, the use of the liquid crystal material with the low dielectric constant may reduce drive characteristics of the liquid crystal. According to the experimental findings, as the amount of impurities ionized inside the liquid crystal layer increases and an acceleration factor becomes large, an appearance time of the stains becomes rapider. The acceleration factor may include a temperature, time, a DC drive of the liquid crystal, and the like. For example, when a period during which a DC voltage of the same polarity is applied to the liquid crystal layer becomes longer at a high temperature, the stains worsen and the appearance time of the stains becomes rapider. Because the stains non-uniformly appear between display panels manufactured through the same manufacture line, the stain problem cannot be solved only a development of new material or an improvement of process.

In the liquid crystal display, a blur phenomenon occurs in which a moving picture displayed on the screen of the liquid crystal display panel is not clear and blurry because of hold characteristics of the liquid crystal material. The CRT provides data to cells by causing a phosphor to emit light for a very short period of time so as to display an image in an impulse drive manner. On the other hand, the liquid crystal display displays an image in a hold drive manner by supplying data to liquid crystal cells during a scan period and by holding data charged to the liquid crystal cells during a remaining field period (or a frame period). In the liquid crystal display, light and darkness of a perceived image which a viewer feels are not clear and blurry because of the hold characteristics of the liquid crystals.

SUMMARY OF THE INVENTION

Accordingly, an exemplary embodiments is to provide a liquid crystal display and a method of driving the same capable of being impulse driven and suppressing a staining phenomenon caused by the polarization and accumulation of ions.

Additional features and advantages of the exemplary embodiments will be set forth in the description which follows, and in part will be apparent from the description, or may be learned by practice of the exemplary embodiments. The objectives and other advantages of the exemplary embodiments will be realized and attained by the structure particularly pointed out in the written description and claims hereof as well as the appended drawings.

To achieve these and other advantages and in accordance with the purpose of embodiments, as embodied and broadly described, a liquid crystal display comprises a liquid crystal display panel including a plurality of liquid crystal cells arranged at crossings of a plurality of data lines and a plurality of gate lines in a matrix format, a timing signal multiplying circuit that multiplies a frequency of a timing signal, a timing control signal generating circuit that generates a polarity control signal based on the timing signal, whose the frequency is multiplied by the timing signal multiplying circuit, a polarity control signal inverting circuit that inverts the polarity control signal in response to an inverse periodic signal, that is inverted every constant time interval, to generate an inverse polarity control signal, a data drive circuit that respectively converts digital video data and digital black data into a video data voltage and a black gray level voltage, inverts a polarity of the video data voltage and a polarity of the black gray level voltage in response to the inverse polarity control signal, and supplies the video data voltage and the black gray level voltage, whose the polarities are inverted, to the data lines, and a gate drive circuit that supplies gate pulses to the gate lines.

Each of pulses of the inverse periodic signal is synchronized with the black gray level voltage.

A rising edge and a falling edge of the inverse periodic signal are synchronized with the black gray level voltage.

The liquid crystal display further comprises a memory controller that generates a write address signal based on the timing signal, generates a read address signal based on the multiplied timing signal, and controls a memory storing the digital video data, a multiplexer that selects the digital black data and the digital video data stored in the memory under the control of the timing signal multiplying circuit, an interface circuit that supplies the digital black data and the digital video data selected by the multiplexer to the data drive circuit, and a periodic signal generating unit that generates the inverse periodic signal depending on periodic data received from the outside. The polarity control signal inverting circuit includes an exclusive OR (XOR) circuit that performs an XOR operation on the polarity control signal and the inverse periodic signal to generate the inverse polarity control signal.

In another aspect, a method of driving a liquid crystal display including a liquid crystal display panel, that includes a plurality of liquid crystal cells arranged at crossings of a plurality of data lines and a plurality of gate lines in a matrix format, the method comprises multiplying a frequency of a timing signal, generating a polarity control signal based on the multiplied timing signal, inverting the polarity control signal in response to an inverse periodic signal, that is inverted every constant time interval, to generate an inverse polarity control signal, respectively converting digital video data and digital black data into a video data voltage and a black gray level voltage, inverting a polarity of the video data voltage and a polarity of the black gray level voltage in response to the inverse polarity control signal, and supplying the video data voltage and the black gray level voltage, whose the polarities are inverted, to the data lines, and supplying gate pulses to the gate lines.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments examples of which are illustrated in the accompanying drawings.

Figure 1:
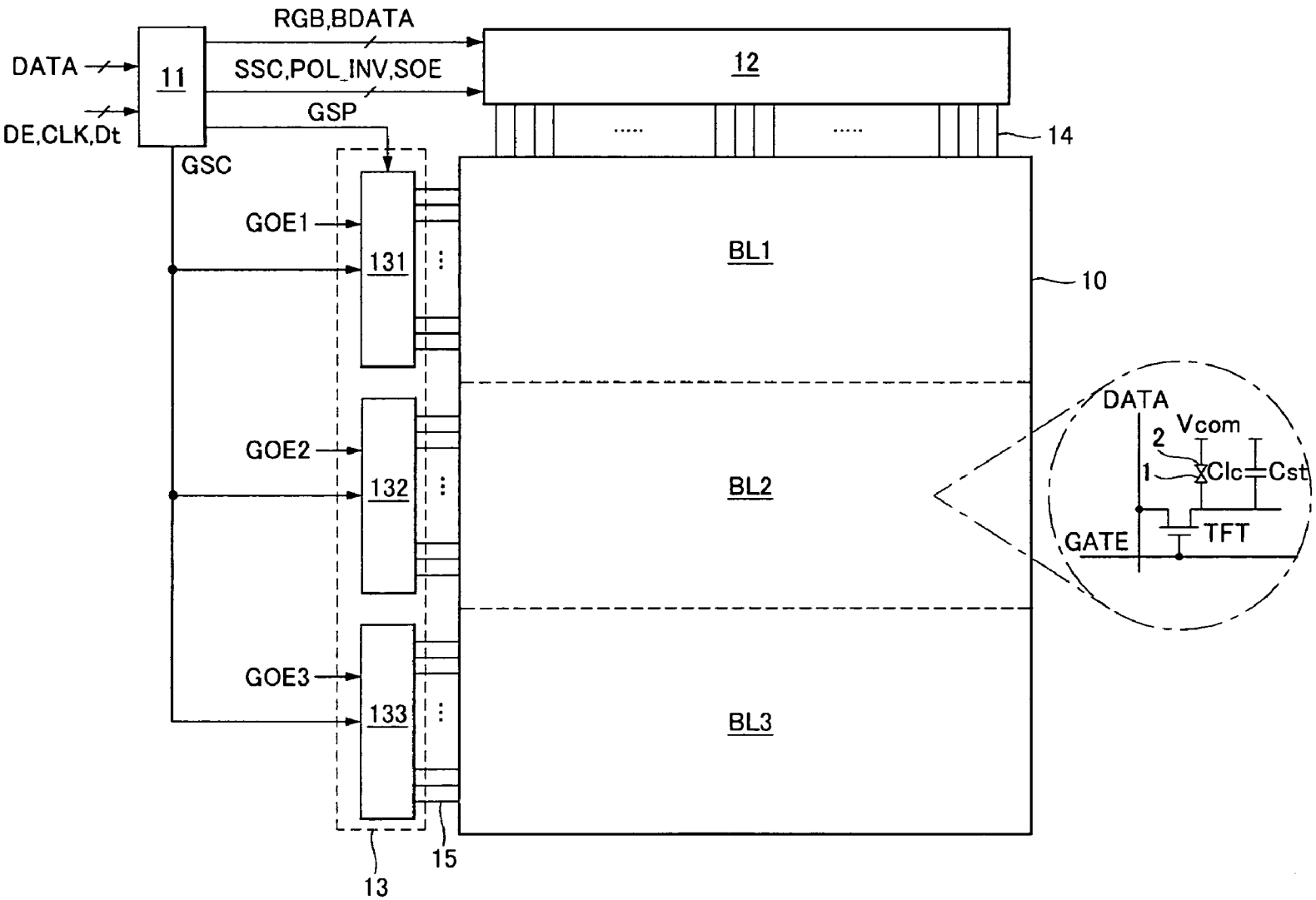
FIG. 1 is a block diagram of a liquid crystal display according to a first exemplary embodiment.

As shown in FIG. 1, a liquid crystal display according to a first exemplary embodiment includes a liquid crystal display panel 10, a timing controller 11, a data drive circuit 12, and a gate drive circuit 13. The data drive circuit 12 includes a plurality of data driver integrated circuits (IC) (not shown). The gate drive circuit 13 includes a plurality of gate driver ICs 131 to 133.

In the liquid crystal display panel 10, a liquid crystal layer is formed between two glass substrates. The liquid crystal display panel 10 includes m×n liquid crystal cells Clc arranged at each crossing of m data lines 14 and n gate lines 15 in a matrix format.

The data lines 14, the gate lines 15, thin film transistors (TFTs), and a storage capacitor Cst are formed on a lower glass substrate of the liquid crystal display panel 10. The liquid crystal cells Clc are connected to the TFTs and are driven by an electric field between pixel electrodes 1 and a common electrode 2. A black matrix, a color filter, and a common electrode 2 are formed on an upper glass substrate of the liquid crystal display panel 10. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizing plates are respectively attached to the upper and lower glass substrates of the liquid crystal display panel 10. Alignment layers for setting a pre-tilt angle of the liquid crystal are respectively formed on the upper and lower glass substrates.

A display screen of the liquid crystal display panel 10 is division-driven by dividing the display screen into a plurality of blocks BL1 to BL3 depending on gate timing control signals applied to the gate driver ICs 131 to 133. Each of the blocks BL1 to BL3 is time division driven by going through a video data charge period during which each block is charged to a video data voltage every 1 line, a data hold period during which each block is held at a data voltage, and a black charge period during which each block is simultaneously charged to a black gray level voltage every two or more lines. In the present embodiment, the line means a pixel row.

Figure 2:
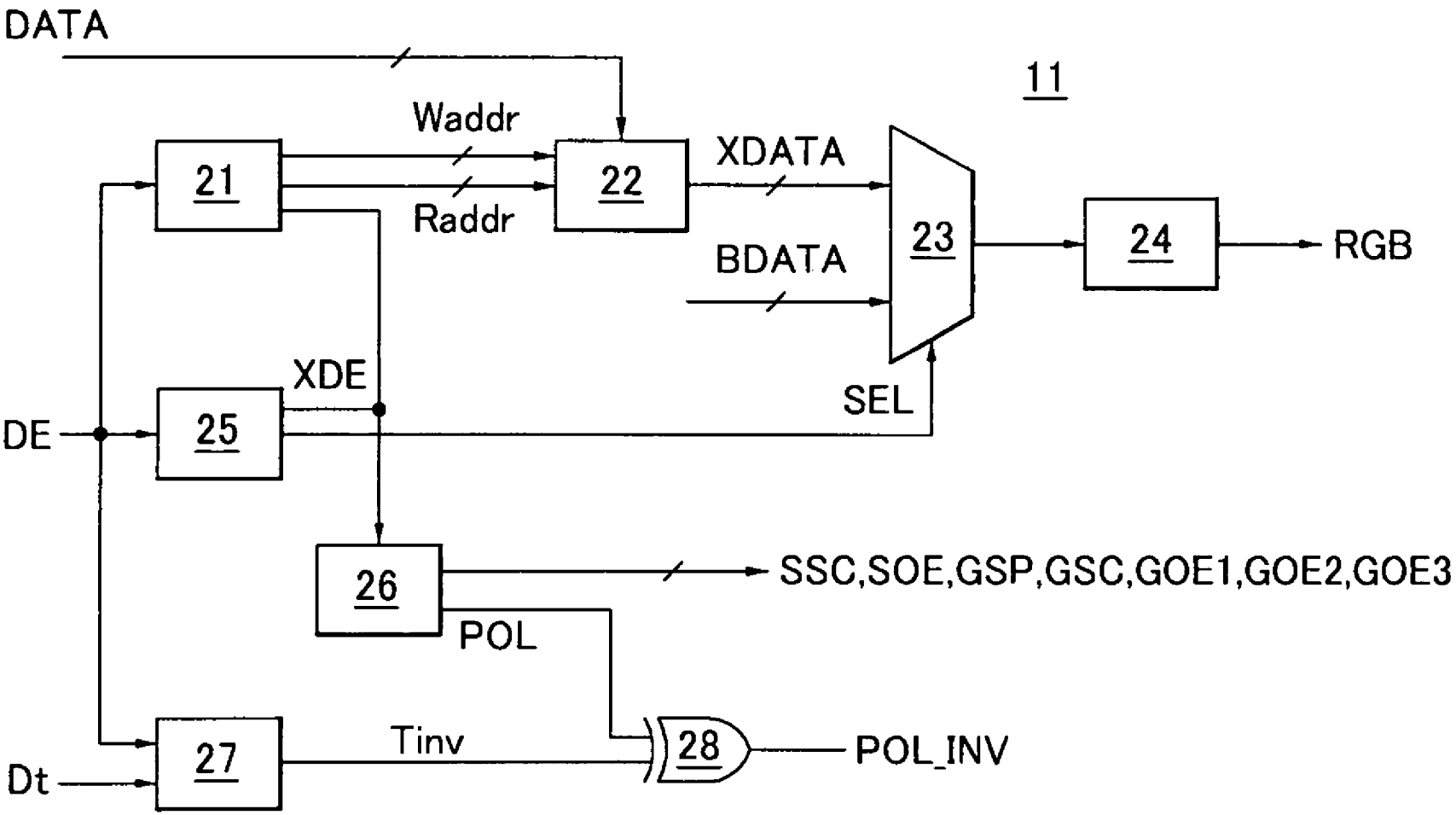
FIG. 2 is a block diagram showing in detail a timing controller shown in FIG. 1.

The timing controller 11 receives timing signals, such as a data enable signal DE and a dot clock CLK, and generates control signals for controlling operation timing of the data drive circuit 12 and operation timing of the gate drive circuit 13. A frequency of the control signals is 1.25 times higher than a frequency of an input frame. The control signals include a data timing control signal and a gate timing control signal. The timing controller 11 allows a transmission frequency of digital video data DATA received from an external system board to be larger than an input frequency. Then, the timing controller 11 periodically inserts digital black data BDATA into digital video data RGB, whose a transmission frequency increases, to supply it to the data drive circuit 12. A circuit configuration of the timing controller 11 is illustrated in FIG. 2.

Figure 9:
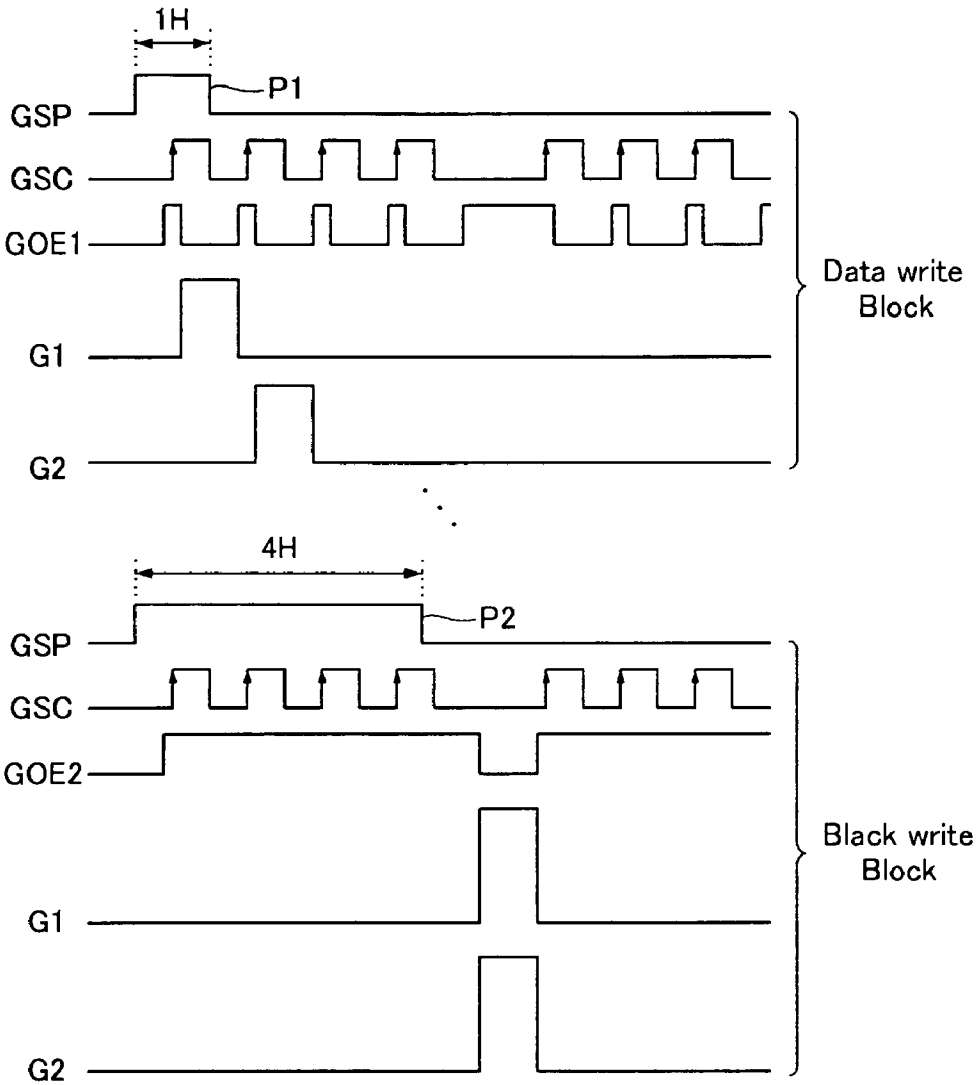
FIG. 9 is a waveform diagram of gate pulses output by first and second gate driver ICs during a period T1 in the liquid crystal display according to the first exemplary embodiment.

The gate timing control signal includes a gate start pulse GSP, a gate shift clock GSC, first to third gate output enable signals GOE1 to GOE3, and so on. The gate start pulse GSP is applied to only the first gate driver IC 131 to thereby indicate a scan start line of a scan operation so that the first gate driver IC 131 generates a first gate pulse. The second and third gate driver ICs 132 and 133 receive a carry signal generated by the first gate driver IC 131 as a gate start pulse to operate. The gate start pulse GSP, as shown in FIG. 9, includes a first pulse P1 and a second pulse P2 following the first pulse P1. The first pulse P1 allows the gate driver IC scanning a data write block to start to operate. A width of the second pulse P2 is larger than a width of the first pulse P1. The second pulse P2 allows the gate driver IC scanning a black write block to start to operate. The gate shift clock GSC is a clock signal for shifting the gate start pulse GSP. The first to third gate output enable signals GOE1 to GOE3 are independently applied to the gate driver ICs 131 to 133. The gate driver ICs 131 to 133 output gate pulses during low logic periods of the gate output enable signals GOE1 to GOE3, i.e., during a period of time ranging from immediately after a falling time of a pulse to immediately before a rising time of a next pulse. The gate driver ICs 131 to 133 do not generate the gate pulse during high logic periods of the gate output enable signals GOE1 to GOE3.

The data timing control signal includes a source sampling clock SSC, an inverse polarity control signal POL_INV, a source output enable signal SOE, and so on. The source sampling clock SSC directs a data latch operation to the data drive circuit 12 based on a rising or falling edge. The inverse polarity control signal POL_INV controls polarities of a video data voltage and a black gray level voltage output by the data drive circuit 12. The source output enable signal SOE controls an output of the data drive circuit 12.

The timing controller 11 periodically inverts an internal polarity control signal in response to periodic data Dt to generate the inverse polarity control signal POL_INV. The periodic data Dt is input to the timing controller 11 through an external system board or a user interface or is stored in a register inside the timing controller 11.

Figure 3:
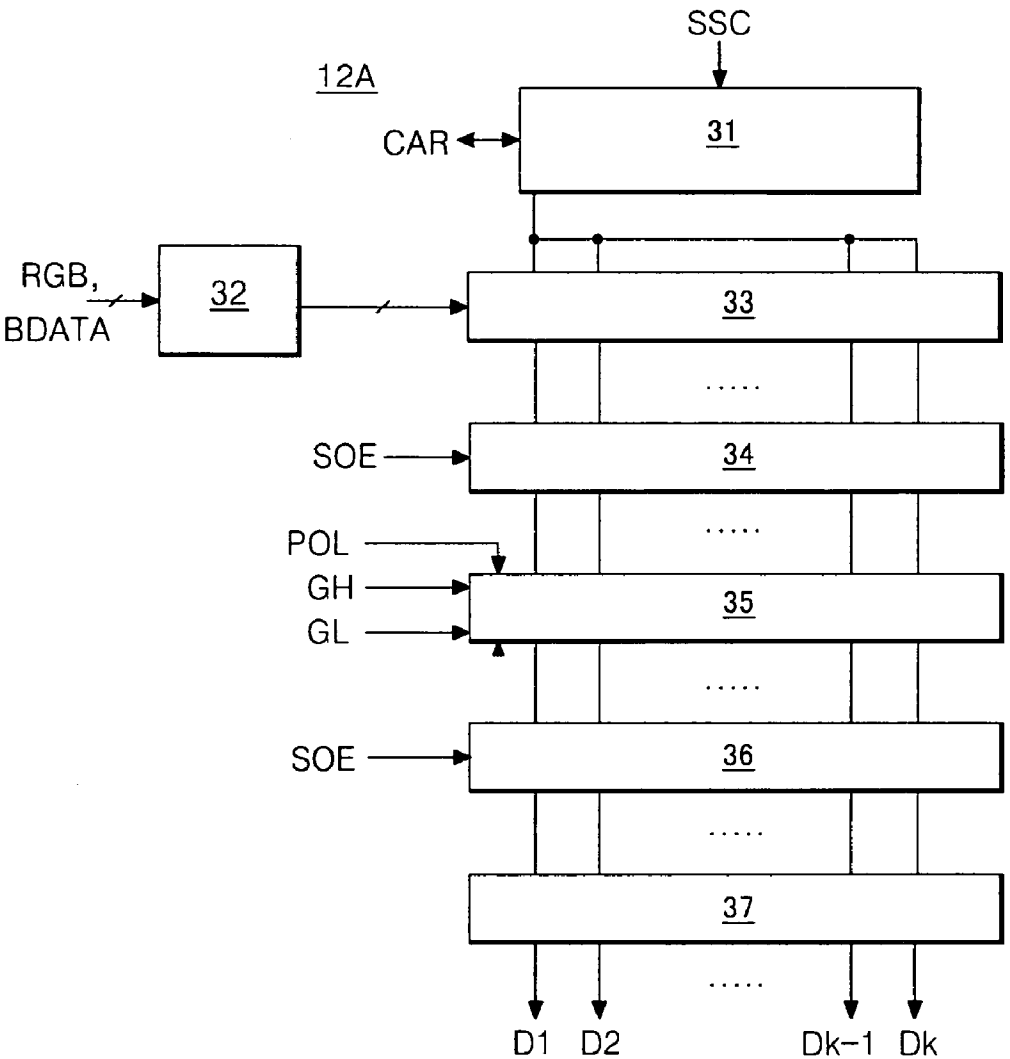
FIG. 3 is a block diagram showing in detail a data driver integrated circuit (IC) shown in FIG. 1.
Figure 4:
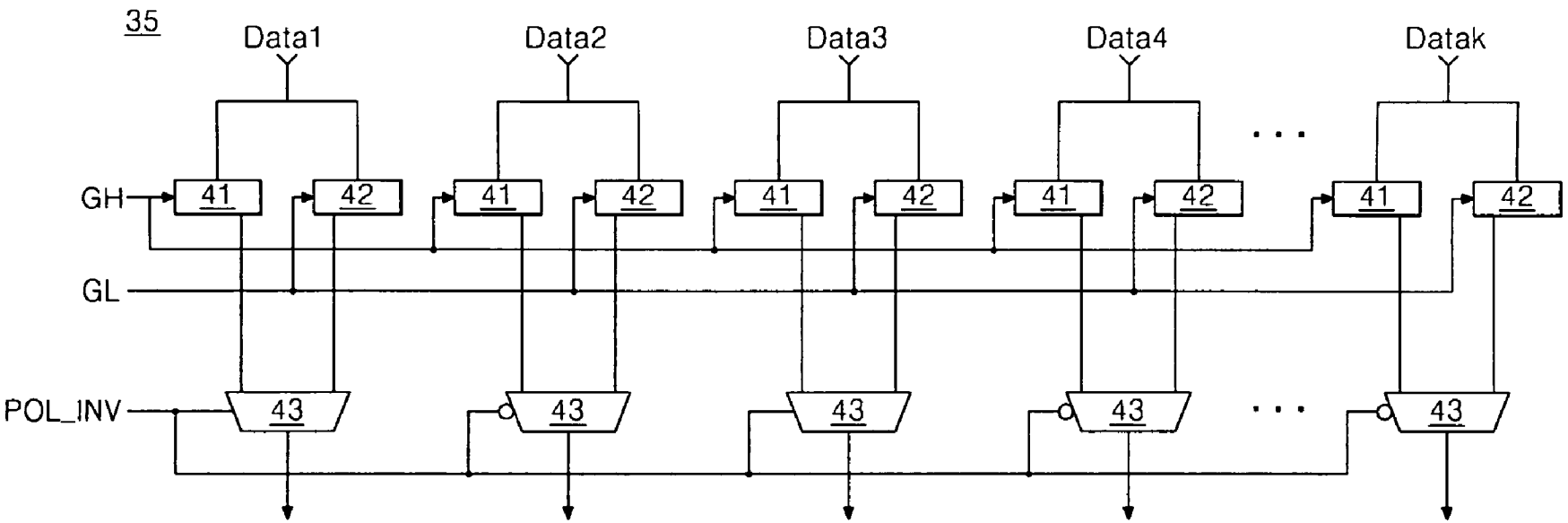
FIG. 4 is a circuit diagram showing in detail a digital-to-analog converter shown in FIG. 3.

The data drive circuit 12 latches the digital video data RGB and the digital black data BDATA under the control of the timing controller 11. The data drive circuit 12 converts the digital video data RGB and the digital black data BDATA into an analog positive or negative gamma compensation voltage in response to the inverse polarity control signal POL_INV to thereby generate a positive or negative analog video data voltage and a positive or negative black gray level voltage. Then, the data drive circuit 12 supplies these voltages to the data lines 14. After the data drive circuit 12 outputs the positive/negative analog video data voltage during 4 horizontal periods, the data drive circuit 12 outputs the positive/negative black gray level voltage during 1 horizontal period. These output operation is repeatedly performed. A circuit configuration of each of the data driver ICs of the data drive circuit 12 is illustrated in FIGS. 3 and 4.

Figure 5:
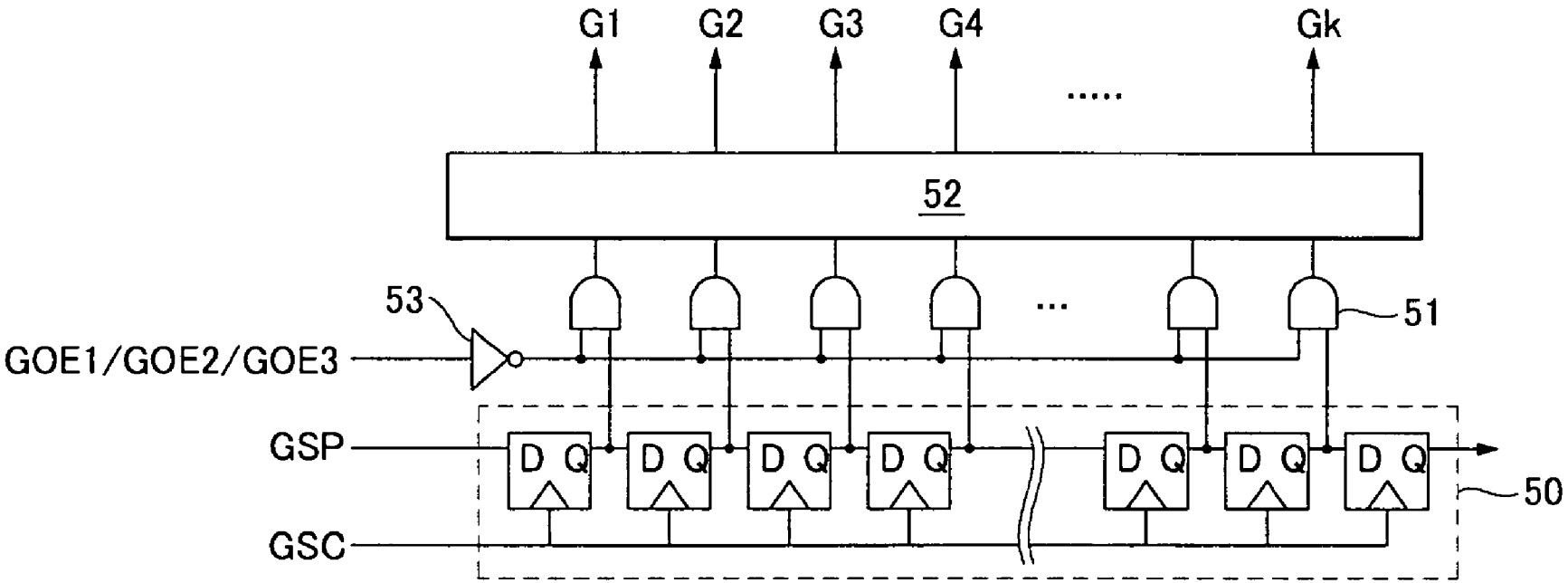
FIG. 5 is a circuit diagram showing in detail a gate driver IC shown in FIG. 1.

The gate drive circuit 13 sequentially supplies the gate pulses to the gate lines 15 under the control of the timing controller 11. A circuit configuration of each of the gate driver ICs of the gate drive circuit 13 is illustrated in FIG. 5.

When the gate driver ICs 131 to 133 of the gate drive circuit 13 scan data write blocks, the gate driver ICs 131 to 133 sequentially apply the gate pulses to the 4 gate lines 15 during 4 horizontal periods in response to a first pulse of the gate start pulse GSP received from the timing controller 11 or the previous gate driver IC, the gate shift clock GSC, and the gate output enable signals GOE1 to GOE3 having small duty ratios. After 1 horizontal period, the gate driver ICs 131 to 133 start to output the gate pulses. The data drive circuit 12 supplies the positive/negative analog video data voltage to the data lines 14 in synchronization with the gate pulses.

When the gate driver ICs 131 to 133 of the gate drive circuit 13 scan black write blocks, the gate driver ICs 131 to 133 do not perform an output operation during 4 horizontal periods in response to a second pulse of the gate start pulse GSP received from the timing controller 11 or the previous gate driver IC, the gate shift clock GSC, and the gate output enable signals GOE1 to GOE3 having long duty ratios. Then, the gate driver ICs 131 to 133 repeat an operation to simultaneously supply the gate pulses to the 4 gate lines 15 during 1 horizontal period. The data drive circuit 12 supplies the positive/negative black gray level voltage to the data lines 14 in synchronization with the gate pulses.

FIG. 2 illustrates in detail the timing controller 11.

As shown in FIG. 2, the timing controller 11 includes a memory controller 21, a memory 22, a multiplexer 23, an interface circuit 24, a timing signal multiplying circuit 25, a timing control signal generating circuit 26, a periodic signal generating unit 27, and an exclusive OR (symbolized XOR or EOR) circuit 28.

The memory controller 21 generates a write address signal Waddr in conformity with the data enable signal DE and generates a read address signal Raddr in conformity with a data enable signal XDE, whose a frequency is 1.25 times higher than a frequency of the data enable signal DE. A reason to increase an output speed of the memory controller 21 is that the timing controller 11 outputs digital blocks as well as data on the 4 data lines during a period of time when an existing timing controller outputs data on 4 data lines.

The memory 22 stores digital video data in response to the write address signal Waddr and outputs the stored digital video data in response to the read address signal Raddr.

The multiplexer 23 selects digital video data XDATA output by the memory 22 and digital black data BDATA in response to a selection signal SEL output by the timing signal multiplying circuit 25. After the multiplexer 23 supplies the digital video data XDATA of 4 lines to the interface circuit 24 in response to a first logic level of the selection signal SE during 4 horizontal periods, the multiplexer 23 supplies the digital black data BDATA to the interface circuit 24 in response to a second logic level of the selection signal SE during 1 horizontal period.

The interface circuit 24 transmits the digital video data RGB, the digital black data BDATA, and a mini low-voltage differential signaling (LVDS) clock to the data drive circuit 12 in a mini LVDS interface.

The timing signal multiplying circuit 25 multiplies a frequency of the data enable signal DE by 1.25. The data enable signal DE is generated every 1 horizontal period based on an input frequency. Therefore, when an input frame frequency is 60 Hz, the liquid crystal display 10 is driven at a frame frequency of 75 Hz. The timing signal multiplying circuit 25 counts the multiplied data enable signal DE. When the timing signal multiplying circuit 25 divides a count value by 5 to give 0, the timing signal multiplying circuit 25 resets the count value and inverts a logic level of the selection signal SEL to obtain a second logic level. The data enable signal XDE, whose the frequency is multiplied by the timing signal multiplying circuit 25, is input to the memory controller 21 and the timing control signal generating circuit 26.

The timing control signal generating circuit 26 generates the gate timing control signals, such as the gate start pulse GSP, the gate shift clock signal GSC, and the gate output enable signals GOE1 to GOE3, and the data timing control signals, such as the source sampling clock signal SSC, the source output enable signal SOE, and the polarity control signal POL. The frequencies of the gate timing control signals and the frequencies of the data timing control signals generated by the timing control signal generating circuit 26 are 1.25 times higher than the existing technology not having an impulse effect based on the multiplied data enable signal XDE.

The periodic signal generating unit 27 generates an inverse periodic signal Tinv, which is inverted every predetermined time interval, depending on the periodic data Dt to supply the inverse periodic signal Tinv to the XOR circuit 28. The XOR circuit 28 performs an XOR operation on the polarity control signal POL and the inverse periodic signal Tinv to output the inverse polarity control signal POL_INV.

FIGS. 3 and 4 illustrate a data driver IC 12A.

As shown in FIGS. 3 and 4, each data driver IC 12A includes a shift register 31, a data restoring unit 32, a first latch array 33, a second latch array 34, a digital-to-analog converter (DAC) 35, a charge share circuit 36, and an output circuit 37.

The data restoring unit 32 temporarily stores the digital video data RGB and the digital black data BDATA received from the timing controller 11 and restores data in the mini LVDS interface to supply the restored data to the first latch array 33.

The shift register 31 shifts a sampling signal in response to the source sampling clock signal SSC. When data more than the number of latches of the first latch array 33 is supplied, the shift register 31 generates a carry signal CAR.

The first latch array 33 samples and latches the digital video data RGB and the digital black data BDATA received from the data restoring unit 32 in response to the sampling signals sequentially received from the shift register 31. Then, the first latch array 33 simultaneously outputs the digital video data RGB and the digital black data BDATA.

The second latch array 34 latches the data received from the first latch array 33. Then, the second latch array 34 of one data driver ICs 12A and the second latch arrays 34 of the other data driver ICs 12A simultaneously output the latched data during a low logic period of the source output enable signal SOE.

The DAC 35, as shown in FIG. 4, includes a P-decoder 41 to which a positive gamma compensation voltage GH is supplied, a N-decoder 42 to which a negative gamma compensation voltage GL is supplied, and a multiplexer 43 selecting an output of the P-decoder 41 and an output of the N-decoder 41 in response to the inverse polarity control signal POL_INV. The P-decoder 41 decodes the data received from the second latch array 34 to output the positive gamma compensation voltage GH corresponding to gray values of the data. The N-decoder 42 decodes the data received from the second latch array 34 to output the negative gamma compensation voltage GL corresponding to gray values of the data. The multiplexer 43 selects the positive gamma compensation voltage GH and the negative gamma compensation voltage GL in response to the inverse polarity control signal POL_INV.

The charge share circuit 36 shorts neighboring data output channels during a high logic period of the source output enable signal SOE to output an average value of neighboring data voltages as a charge share voltage. Or, the charge share circuit 36 supplies a common voltage Vcom to the data output channels during the high logic period of the source output enable signal SOE to reduce sharp changes in a positive voltage and a negative voltage to be supplied to the data lines 14.

The output circuit 37 includes a buffer to thereby minimize the signal attenuation of the positive/negative analog video data voltage and the positive/negative black gray level voltage supplied to the data lines D1 to Dk.

FIG. 5 illustrates the gate driver ICs 131 to 133.

As shown in FIG. 5, each of the gate driver ICs 131 to 133 includes a shift register 50, a level shifter 52, a plurality of AND gates 51 connected between the shift register 50 and the level shifter 52, and an inverter 53 for inverting the gate output enable signals GOE1 to GOE3.

The shift register 50 sequentially shifts the gate start pulse GSP depending on the gate shift clock GSC using a plurality of cascade connected D flip-flops. Each of the AND gates 51 performs an AND operation on an output signal of the shift register 50 and inverse signals of the gate output enable signals GOE1 to GOE3 to produce a logic output. The inverter 53 inverts the gate output enable signals GOE1 to GOE3 to supply the inverse signals of the gate output enable signals GOE1 to GOE3 to the AND gates 51. Accordingly, the gate driver ICs 131 to 133 produce outputs only when the gate output enable signals GOE1 to GOE3 are in a low logic period.

The level shifter 52 shifts a swing width of an output voltage of the AND gates 51 within the range of an operation voltage of a TFT inside a pixel array of the liquid crystal display panel 10. Output signals G1 to Gk of the level shifter 52 are sequentially supplied to the k gate lines 15, where k is an integer. The level shifter 52 is positioned in front of the shift register 50. The shift register 50 and the TFT of the pixel array may be directly positioned on the glass substrate of the liquid crystal display panel 10.

Figure 6:
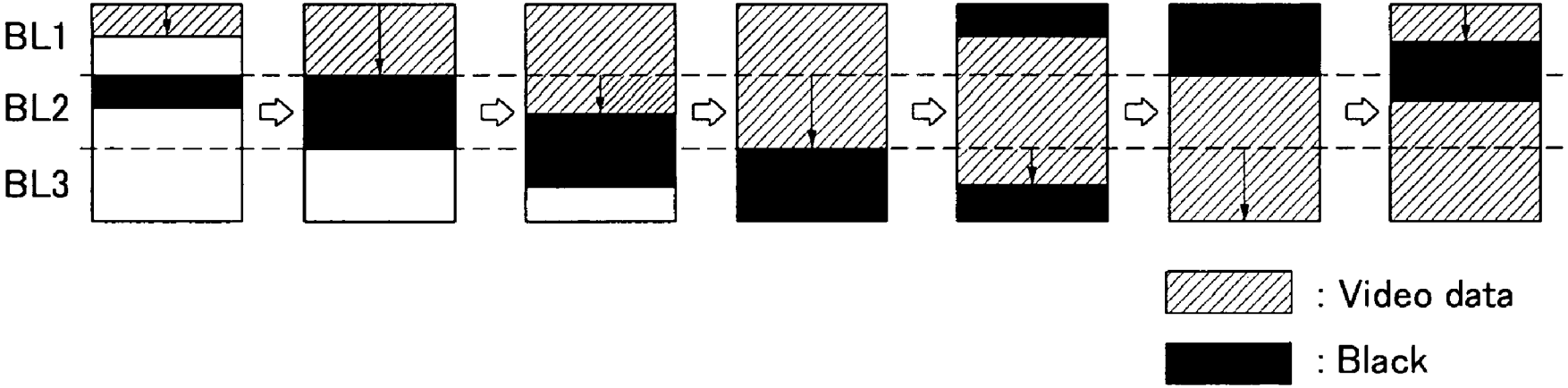
FIGS. 6 to 8 illustrate an exemplary scanning operation of video data and black data in the liquid crystal display according to the first exemplary embodiment.
Figure 7:
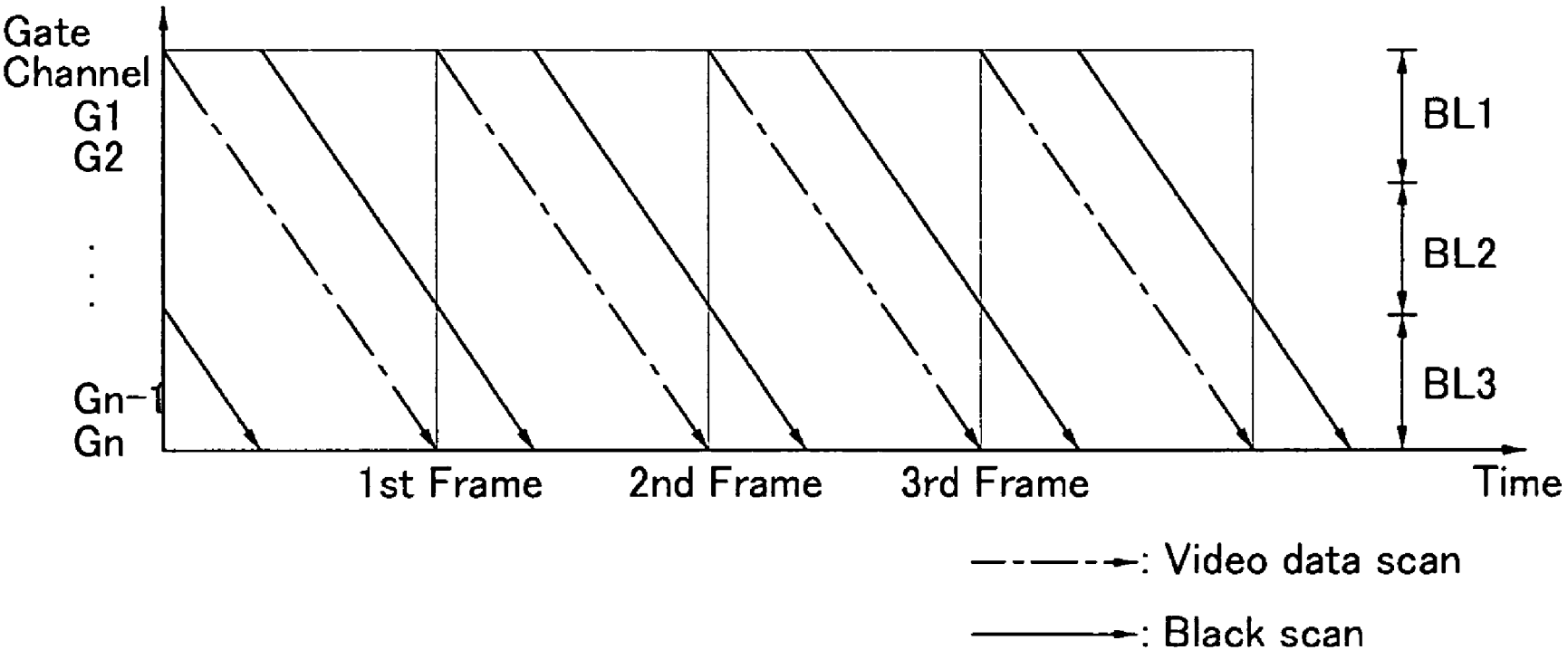
Figure 8:
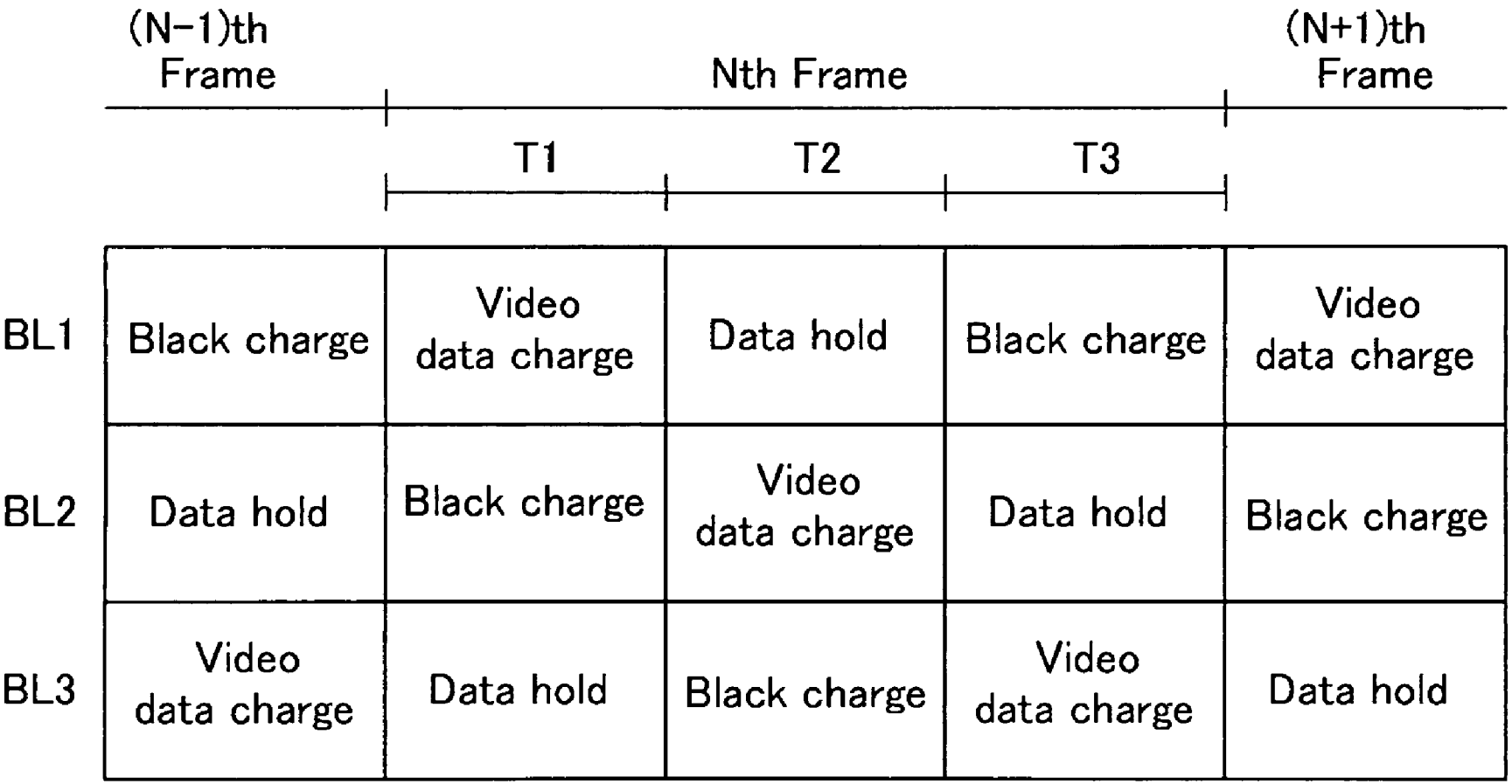

As shown in FIGS. 6 to 8, the liquid crystal display according to the first exemplary embodiment is impulse driven by charging one block of the liquid crystal display panel 10 to the positive/negative black gray level voltage or holding the one block at a previously charged video data voltage while another block is charged to the positive/negative analog video data voltage. Each of the blocks BL1 to BL3 sequentially goes through a video data charge operation, a data hold operation, and a black charge operation during 1 frame period (1/75 sec). This will be described in detail in relation to a waveform diagram of FIG. 9.

During a period T1, the first gate driver IC 131 starts to operate in response to the first pulse P1 of the gate start pulse GSP generated as soon as the period T1 starts. In the gate shift clock GSC, after a pulse is generated every 1 horizontal period during 4 horizontal periods, the pulse is again generated after 2 horizontal periods. In the first gate output enable signal GOE1, after a pulse is generated every 1 horizontal period during 4 horizontal periods, the pulse is hold at a high logic level during 1 horizontal period. Then, the pulse is again generated every 1 horizontal period. As a result, after the first gate driver IC 131 sequentially supplies the gate pulses to the 4 gate lines during 4 horizontal periods, the first gate driver IC 131 stops an output during 1 horizontal period. Then, the first gate driver IC 131 repeats an operation to sequentially supply the gate pulses to the gate lines. The liquid crystal cells of the first block BL1 scanned by the first gate driver IC 131 are sequentially charged to the positive/negative analog video data voltage received from the data drive circuit 12 in each line during the period T1. As soon as the period T1 starts, the second gate driver IC 132 receives the carry signal from the first gate driver IC 131. The gate shift clock GSC applied to the second gate driver IC 132 is the same as the gate shift clock GSC applied to the first gate driver IC 131. In the second gate output enable signal GOE2 applied to the second gate driver IC 132, after a pulse is hold at a high logic level during the 4 horizontal periods, when 4 lines are charged to the positive/negative analog video data voltage in the first block BL1, the pulse is inverted at a low logic level during 1 horizontal period. Then, a pulse having a width corresponding to a length of 4 horizontal periods is again generated. As a result, in the second gate driver IC 132, a carry signal having a width corresponding to a length of 4 or more horizontal periods is shifted at a time interval of 1 horizontal period, and thus the carry signals overlap each other. An overlap pulse width of the carry signals corresponds to a length of 3 or more horizontal periods. The gate pulses generated by the second gate driver IC 132 are simultaneously supplied to the 4 gate lines because of the overlap of the carry signals during horizontal periods corresponding to a multiple of 5, when the second gate output enable signal GOE2 is hold at a low logic level. Accordingly, the liquid crystal cells of the second block BL2 scanned by the second gate driver IC 132 are simultaneously charged to the positive/negative black gray level voltage received from the data drive circuit 12 every 4 lines during the period T1. The third gate driver IC 133 does not receive the carry signal from the second gate driver IC 132 during the period T1. Therefore, the third block BL3 is hold at the video data voltage to which the liquid crystal cells of the third block BL3 were charged during a period T3 of a previous frame.

During a period T2, the first gate driver IC 131 does not receive the gate start pulse GSP from the timing controller 11. Hence, because the first gate driver IC 131 does not generate the gate pulse during the period T2, the first block BL1 is hold at the data voltage to which the liquid crystal cells of the first block BL1 were charged during the period T1. As soon as the period T2 starts, the second gate driver IC 132 receives the first pulse P1 of the gate start pulse GSP from the first gate driver IC 131 as the carry signal. Accordingly, after the second gate driver IC 132 sequentially supplies the gate pulses to the 4 gate lines during 4 horizontal periods, the second gate driver IC 132 stops an output during 1 horizontal period. Then, the second gate driver IC 132 repeats an operation to sequentially supply the gate pulses to the gate lines. The liquid crystal cells of the second block BL2 scanned by the second gate driver IC 132 are sequentially charged to the positive/negative analog video data voltage received from the data drive circuit 12 in each line during the period T2. As soon as the period T2 starts, the third gate driver IC 133 receives the second pulse P2 of the gate start pulse GSP from the second gate driver IC 132 as the carry signal. As a result, after the third gate driver IC 133 simultaneously supplies the gate pulses to the 4 gate lines, the third gate driver IC 133 repeats an operation to simultaneously supply the gate pulses to another 4 gate lines after 4 horizontal periods. Accordingly, the liquid crystal cells of the third block BL3 scanned by the third gate driver IC 133 are simultaneously charged to the positive/negative black gray level voltage received from the data drive circuit 12 every 4 lines during the period T2.

As soon as a period T3 starts, the first gate driver IC 131 receives the second pulse P2 of the gate start pulse GSP from the timing controller 11. As a result, after the first gate driver IC 131 simultaneously supplies the gate pulses to the 4 gate lines during the period T3, the first gate driver IC 131 repeats an operation to simultaneously supply the gate pulses to another 4 gate lines after 4 horizontal periods. Accordingly, the liquid crystal cells of the first block BL1 scanned by the first gate driver IC 131 are simultaneously charged to the positive/negative black gray level voltage received from the data drive circuit 12 every 4 lines during the period T3. The second gate driver IC 132 does not receive the carry signal from the first gate driver IC 131 during the period T3. Hence, because the second gate driver IC 132 does not generate the gate pulse during the period T3, the second block BL2 is hold at the video data voltage to which the liquid crystal cells of the second block BL2 were charged during the period T2. As soon as the period T3 starts, the third gate driver IC 133 receives the first pulse P1 of the gate start pulse GSP from the first gate driver IC 131 as the carry signal. Accordingly, after the third gate driver IC 133 sequentially supplies the gate pulses to the 4 gate lines during the period T3, the third gate driver IC 133 stops an output during 1 horizontal period. Then, the third gate driver IC 133 repeats an operation to sequentially supply the gate pulses to the gate lines. The liquid crystal cells of the third block BL3 scanned by the third gate driver IC 133 are sequentially charged to the positive/negative analog video data voltage received from the data drive circuit 12 in each line during the period T3.

In FIG. 9, G1 to G4 indicate the gate pulses supplied to the gate lines of the data write block charged to the video data voltage and the gate pulses supplied to the gate lines of the black write block charged to the black gray level voltage, and 1H indicates 1 horizontal period. A length of the 1 horizontal period is shorter than a length of 1 horizontal period of the data enable signal DE input to the timing controller 11 in a ratio of 1 to 1.25.

The liquid crystal display according to the first exemplary embodiment periodically inverts a polarity of the black gray level voltage using the inverse polarity control signal POL_INV to periodically invert a motion direction of liquid crystal molecules. As a result, the liquid crystal display according to the first exemplary embodiment can be impulse driven by charging the liquid crystal cells to the video data voltage and then charging the liquid crystal cells to the black gray level voltage, and also can minimize the polarization and accumulation of ions in the liquid crystal layer by periodically inverting the motion direction of the liquid crystal molecules to thereby prevent stain appearance.

Figure 10:
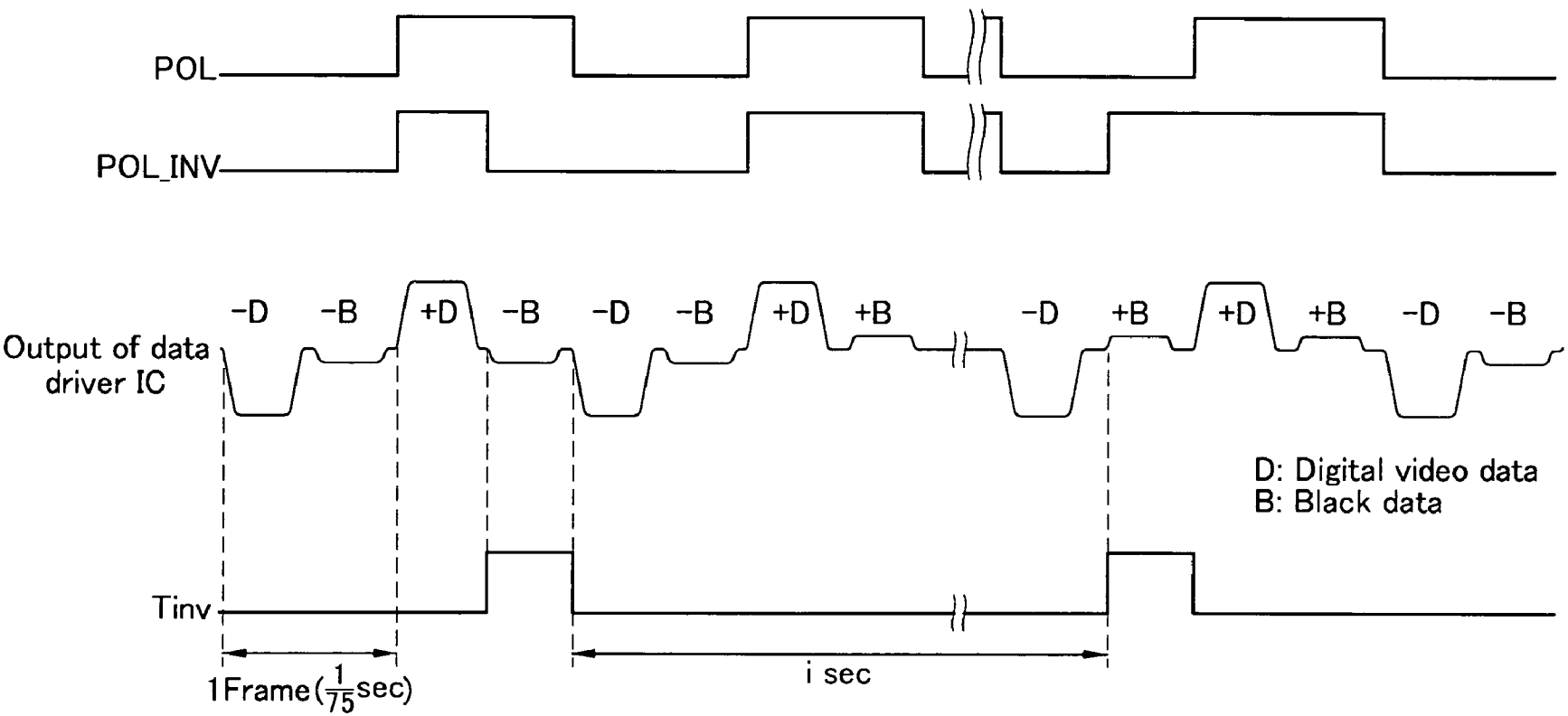
FIGS. 10 to 12 are diagrams showing waveforms of a polarity control signal, an inverse polarity control signal, and an inverse periodic signal and positive and negative analog video data voltages and positive and negative black gray level voltages applied to the liquid crystal display according to the first exemplary embodiment.
Figure 11:
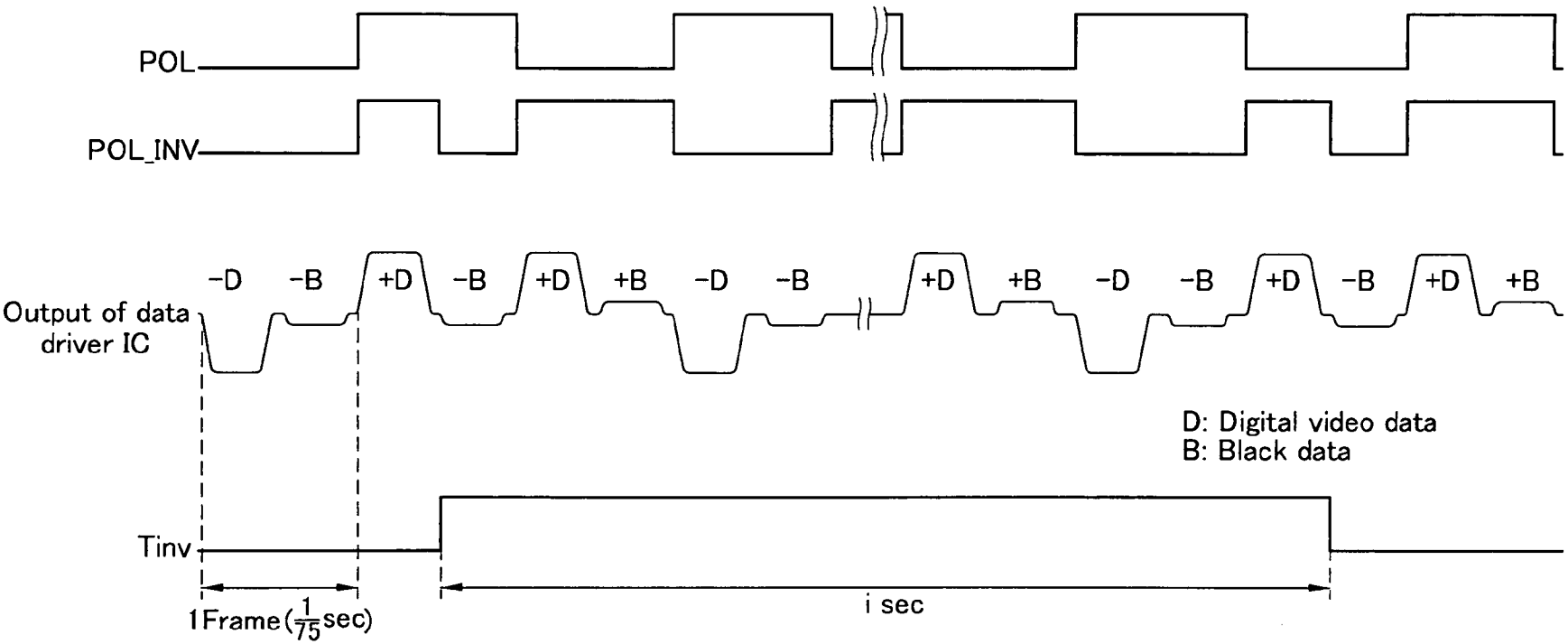
Figure 12:
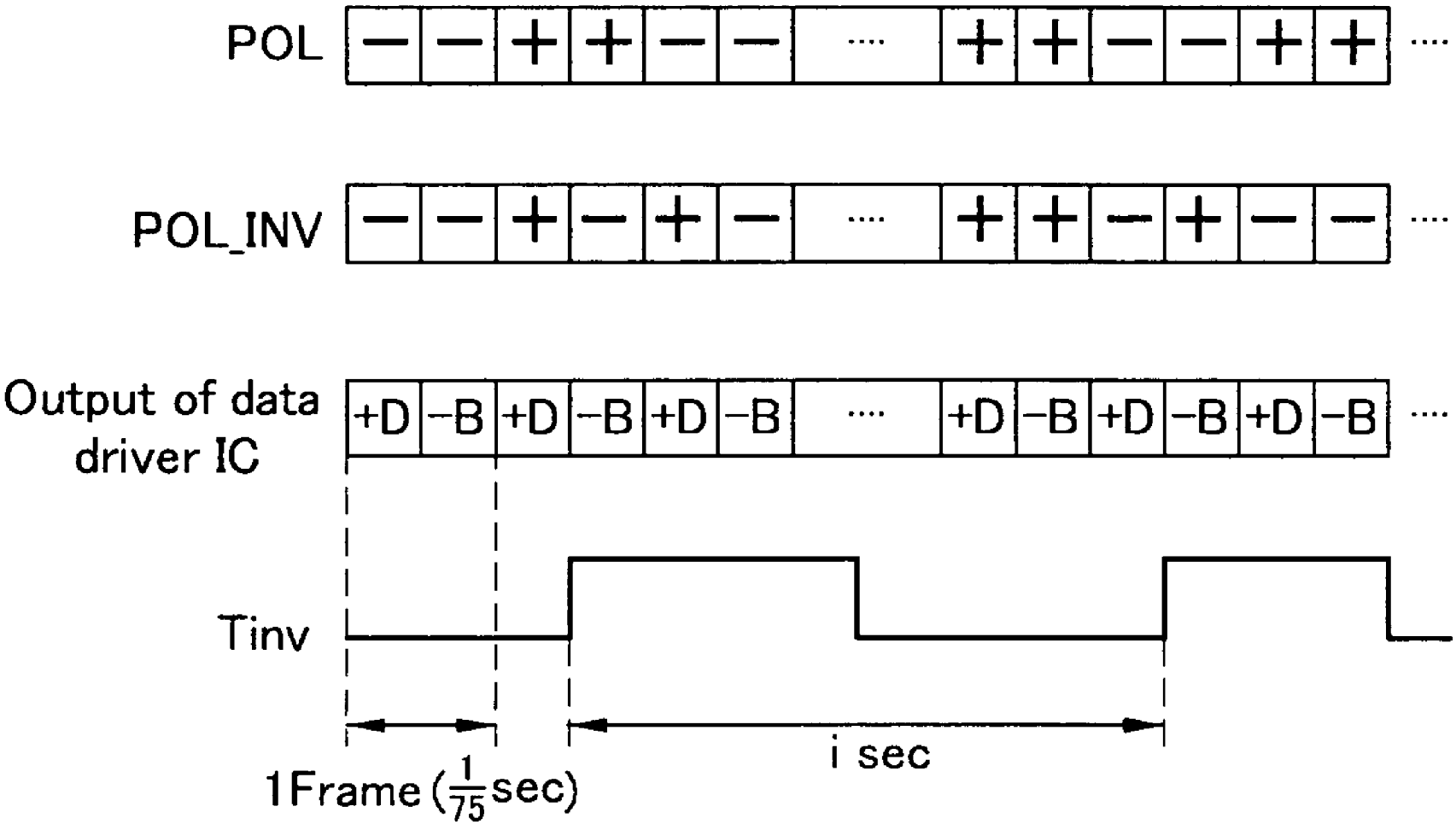

FIGS. 10 to 12 illustrate an inverse period of the inverse polarity control signal POL_INV. More specifically, FIGS. 10 to 12 illustrate waveforms of the polarity control signal POL, the inverse polarity control signal POL_INV, and the inverse periodic signal Tinv and positive and negative analog video data voltages +D and −D and positive and negative black gray level voltages +B and −B controlled by the inverse polarity control signal POL_INV in the liquid crystal display according to the first exemplary embodiment. In FIGS. 10 to 12, the positive and negative analog video data voltages +D and −D and the positive and negative black gray level voltages +B and −B are voltages to which the same liquid crystal cell is charged.

As shown in FIG. 10, the inverse periodic signal Tinv includes pulses generated every "i" sec, where "i" is an integer larger than 2. Each of the pulses of the inverse periodic signal Tinv is synchronized with the black gray level voltage received from the data driver IC 12A. The polarity control signal POL is generated in the substantially same form as a related art polarity control signal. A phase of the polarity control signal POL is periodically inverted so that a polarity of the video data voltage and a polarity of the black gray level voltage, to which the same liquid crystal cell will be charged, are equal to each other during 1 frame period.

The liquid crystal cells are successively charged to the video data voltage and the black gray level voltage, whose the polarities are controlled depending on the inverse polarity control signal POL_INV, during 1 frame period (1/75 sec). Every time the pulse of the inverse periodic signal Tinv synchronized with the black gray level voltage is input, the XOR circuit 28 inverts the polarity control signal POL to generate the inverse polarity control signal POL_INV. Accordingly, every time the pulses of the inverse periodic signal Tinv are input, the liquid crystal cells are charged to the black gray level voltage, whose the polarity is opposite to the polarity of the video data voltage charged prior to the black gray level voltage during 1 frame period. While the inverse periodic signal Tinv is hold at a low logic level, the liquid crystal cells are charged to the black gray level voltage, whose the polarity is the same as the polarity of the video data voltage charged prior to the black gray level voltage.

Accordingly, every time the liquid crystal cells are charged to the black gray level voltage at a time interval corresponding to a width of the pulse of the inverse periodic signal Tinv, the liquid crystal molecules and the ions of the liquid crystal cells move in the opposite direction and are not polarized. As a result, the ions in the liquid crystal layer are not divided depending on polarities of the ions and are not dividedly accumulated.

As shown in FIG. 11, the inverse periodic signal Tinv includes pulses that are generated every 2i sec and have a width of "i" sec. In the inverse periodic signal Tinv, a rising edge of the pulse is synchronized with the black gray level voltage, and a falling edge of the pulse is synchronized with the black gray level voltage generated after the passage of "i" sec from the rising edge. The polarity control signal POL is generated in the substantially same form as the related art polarity control signal. A phase of the polarity control signal POL is periodically inverted so that a polarity of the video data voltage and a polarity of the black gray level voltage, to which the same liquid crystal cell will be charged, are equal to each other during 1 frame period.

The liquid crystal cells are successively charged to the video data voltage and the black gray level voltage, whose the polarities are controlled depending on the inverse polarity control signal POL_INV, during 1 frame period (1/75 sec). The XOR circuit 28 inverts the polarity control signal POL to generate the inverse polarity control signal POL_INV for "i" sec when the pulse of the inverse periodic signal Tinv synchronized with the black gray level voltage is input. Accordingly, while the pulse of the inverse periodic signal Tinv is input, the liquid crystal cells are charged to the video data voltage and the black gray level voltage, whose polarity patterns are opposite to polarity patterns of the video data voltage and the black gray level voltage charged during for "i" sec prior to the "i" sec. Because ions in the liquid crystal layer periodically move in the opposite direction, the polarization and accumulation of ions are suppressed.

As shown in FIG. 12, the inverse periodic signal Tinv includes pulses that are generated every "i" sec and have a width of i/2 sec. In the inverse periodic signal Tinv, a rising edge of the pulse is synchronized with the black gray level voltage, and a falling edge of the pulse is synchronized with the black gray level voltage generated after the passage of "i/2" sec from the rising edge. The polarity control signal POL is generated in the substantially same form as the related art polarity control signal. A phase of the polarity control signal POL is periodically inverted so that a polarity of the video data voltage and a polarity of the black gray level voltage, to which the same liquid crystal cell will be charged, are equal to each other during 1 frame period.

The liquid crystal cells are successively charged to the video data voltage and the black gray level voltage, whose the polarities are controlled depending on the inverse polarity control signal POL_INV, during 1 frame period (1/75 sec). The XOR circuit 28 inverts the polarity control signal POL to generate the inverse polarity control signal POL_INV for "i/2" sec when the pulse of the inverse periodic signal Tinv synchronized with the black gray level voltage is input. Accordingly, while the pulse of the inverse periodic signal Tinv is input, the liquid crystal cells are charged to the video data voltage and the black gray level voltage, whose polarity patterns are opposite to polarity patterns of the video data voltage and the black gray level voltage charged during for "i/2" sec prior to the "i/2" sec. Because ions in the liquid crystal layer periodically move in the opposite direction, the polarization and accumulation of ions are suppressed.

As can be seen from FIGS. 10 to 12, the timing controller 11 inverts the inverse polarity control signal POL_INV in response to the inverse periodic signal Tinv and allows the polarity of the black gray level voltage to be periodically opposite to the polarity of the video data voltage. Further, the timing controller 11 allows the polarity of the black gray level voltage to be equal to the polarity of the video data voltage during a period except a period directed by the inverse periodic signal Tinv.

FIGS. 13 to 19 illustrate a liquid crystal display according to a second exemplary embodiment.

Figure 13:
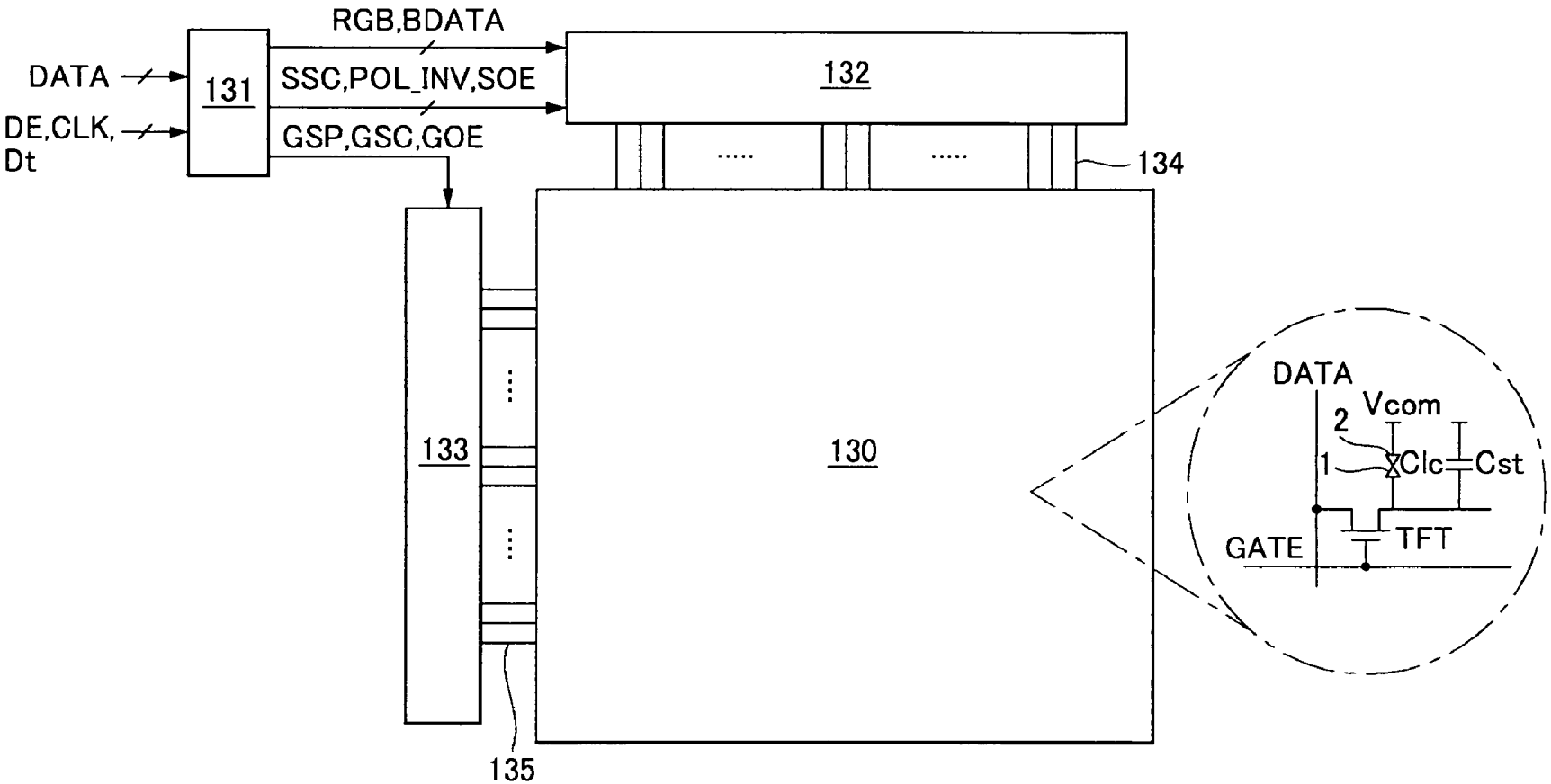
FIG. 13 is a block diagram of a liquid crystal display according to a second exemplary embodiment.

As show in FIG. 13, the liquid crystal display according to the second exemplary embodiment includes a liquid crystal display panel 130, a timing controller 131, a data drive circuit 132, and a gate drive circuit 133. The data drive circuit 132 includes a plurality of data driver ICs (not shown), and the gate drive circuit 133 includes a plurality of gate driver ICs (not shown). A circuit configuration of the data driver ICs is substantially the same as a circuit configuration illustrated in FIGS. 3 and 4, and a circuit configuration of the gate driver ICs is substantially the same as a circuit configuration illustrated in FIG. 5.

Since a structure of the liquid crystal display panel 130 is substantially the same as that described in the first exemplary embodiment, the description thereabout is briefly made or is entirely omitted.

The timing controller 131 receives timing signals, such as a data enable signal DE and a dot clock CLK, and generates control signals for controlling operation timing of the data drive circuit 132 and operation timing of the gate drive circuit 133. A frequency of the control signals is 2 times higher than a frequency of an input frame. The control signals include a data timing control signal and a gate timing control signal. The timing controller 131 allows a transmission frequency of digital video data DATA received from an external system board to be two times higher than an input frequency. The timing controller 131 periodically inserts digital black data BDATA into digital video data RGB to supply it to the data drive circuit 132. A circuit configuration of the timing controller 131 is illustrated in FIG. 2.

The gate timing control signal includes a gate start pulse GSP, a gate shift clock GSC, a gate output enable signal GOE, and so on. In the first exemplary embodiment, while one block of the plurality of blocks is charged to the video data voltage, the gate output enable signals GOE are independently applied to the gate driver ICs scanning the blocks so as to prevent the other blocks from being scanned. On the contrary, in the second exemplary embodiment, after gate pulses synchronized with a video data voltage are sequentially supplied to gate lines 135 on the entire screen of the liquid crystal display panel 130, gate pulses synchronized with a black gray level voltage are sequentially supplied to the gate lines 135 on the entire screen. Therefore, one gate output enable signals GOE is commonly supplied to all the gate driver ICs. The gate start pulse GSP is applied to only the first gate driver IC to thereby indicate a scan start line of a scan operation so that the first gate driver IC generates a first gate pulse. The second and third gate driver ICs receive a carry signal generated by the first gate driver IC as a gate start pulse to operate. The gate start pulse GSP includes a first pulse and a second pulse. The first pulse is generated as soon as 1 frame period starts, and the second pulse is generated after the passage of about ½ frame period. The first pulse allows the first gate driver IC to start to operate so that the first gate driver IC can output a gate pulse synchronized with the video data voltage. The second pulse allows the first gate driver IC to start to operate so that the first gate driver IC can output a gate pulse synchronized with the black gray level voltage. A width of the first pulse is equal to a width of the second pulse. The gate shift clock GSC is a clock signal for shifting the gate start pulse GSP. The gate output enable signal GOE is commonly applied to the gate driver ICs. The gate driver ICs output gate pulses during a low logic period of the gate output enable signal GOE, i.e., during a period of time ranging from immediately after a falling time of a pulse to immediately before a rising time of a next pulse. The gate driver ICs do not generate the gate pulse during a high logic period of the gate output enable signal GOE.

The data timing control signal includes a source sampling clock SSC, an inverse polarity control signal POL_INV, a source output enable signal SOE, and so on. The source sampling clock SSC directs a data latch operation to the data drive circuit 132 based on a rising or falling edge. The inverse polarity control signal POL_INV controls polarities of the video data voltage and the black gray level voltage output by the data drive circuit 132. The source output enable signal SOE controls an output of the data drive circuit 132.

The timing controller 131 periodically inverts an internal polarity control signal in response to periodic data Dt to generate the inverse polarity control signal POL_INV. The periodic data Dt is input to the timing controller 131 through an external system board or a user interface or is stored in a register inside the timing controller 131.

The data drive circuit 132 latches the digital video data RGB and the digital black data BDATA under the control of the timing controller 131. The data drive circuit 132 converts the digital video data RGB and the digital black data BDATA into an analog positive or negative gamma compensation voltage in response to the inverse polarity control signal POL_INV to thereby generate a positive or negative analog video data voltage and a positive or negative black gray level voltage. Then, the data drive circuit 132 supplies these voltages to the data lines 134. After the data drive circuit 132 outputs the positive/negative analog video data voltage during ½ frame period, the data drive circuit 132 outputs the positive/negative black gray level voltage during ½ frame period.

After the gate drive circuit 133 sequentially supplies gate pulses synchronized with the positive/negative analog video data voltage to all the gate lines 135 during ½ frame period under the control of the timing controller 131, the gate drive circuit 133 sequentially supplies gate pulses synchronized with the positive/negative black gray level voltage to all the gate lines 135 during ½ frame period.

Figure 14:
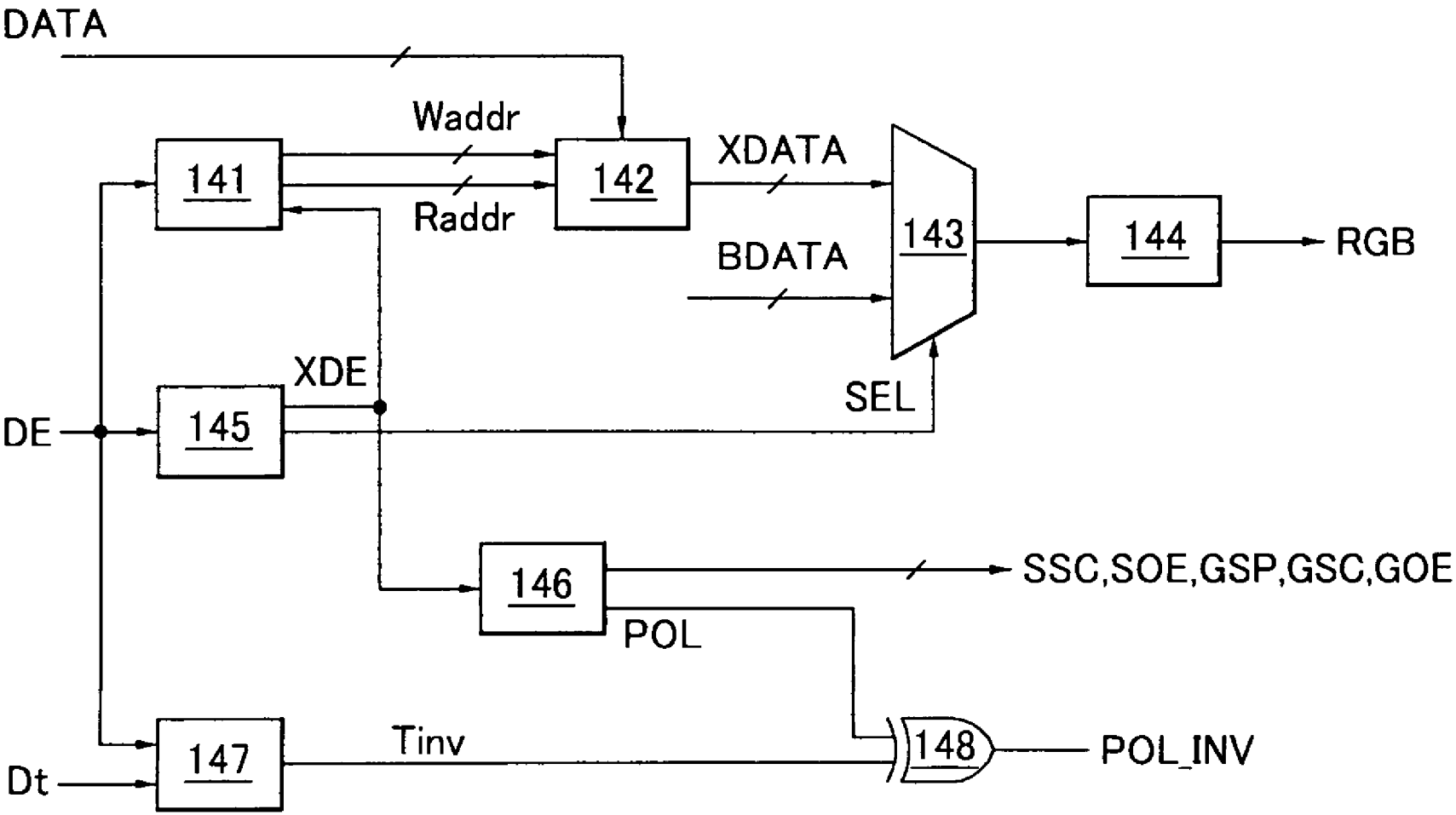
FIG. 14 is a block diagram showing in detail a timing controller shown in FIG. 13.

FIG. 14 illustrates in detail the timing controller 131.

As shown in FIG. 14, the timing controller 131 includes a memory controller 141, a memory 142, a multiplexer 143, an interface circuit 144, a timing signal multiplying circuit 145, a timing control signal generating circuit 146, a periodic signal generating unit 147, and an exclusive OR (symbolized XOR or EOR) circuit 148.

The memory controller 141 generates a write address signal Waddr in conformity with the data enable signal DE and generates a read address signal Raddr in conformity with a data enable signal XDE, whose a frequency is 2 times higher than a frequency of the data enable signal DE. A reason to increase an output speed of the memory controller 141 is that after the liquid crystal cells of the entire screen are charged to the video data voltage during 1 frame period, the liquid crystal cells of the entire screen are charged to the black gray level voltage.

The memory 142 stores digital video data in response to the write address signal Waddr and outputs the stored digital video data in response to the read address signal Raddr.

The multiplexer 143 selects digital video data XDATA output by the memory 142 and digital black data BDATA in response to a selection signal SEL output by the timing signal multiplying circuit 145. After the multiplexer 143 supplies the digital video data XDATA to the interface circuit 144 in response to a first logic level of the selection signal SE during a first half period corresponding to one half of 1 frame period, the multiplexer 143 supplies the digital black data BDATA to the interface circuit 144 in response to a second logic level of the selection signal SE during a second half period corresponding to the other half.

The interface circuit 144 transmits the digital video data RGB, the digital black data BDATA, and a mini low-voltage differential signaling (LVDS) clock to the data drive circuit 132 in a mini LVDS interface.

The timing signal multiplying circuit 145 multiplies a frequency of the data enable signal DE by 2. The data enable signal DE is generated every 1 horizontal period based on an input frequency. Therefore, when an input frame frequency is 60 Hz, the liquid crystal display 130 is driven at a frame frequency of 120 Hz. The timing signal multiplying circuit 145 counts the multiplied data enable signal DE, resets a count value every ½ frame period, and changes a logic level of the selection signal SE into a second logic level. The data enable signal XDE, whose the frequency is multiplied by the timing signal multiplying circuit 145, is input to the memory controller 141 and the timing control signal generating circuit 146.

The timing control signal generating circuit 146 generates the gate timing control signals, such as the gate start pulse GSP, the gate shift clock signal GSC, and the gate output enable signal GOE, and the data timing control signals, such as the source sampling clock signal SSC, the source output enable signal SOE, and the polarity control signal POL. The frequencies of the gate timing control signals and the frequencies of the data timing control signals generated by the timing control signal generating circuit 146 are 2 times higher than the existing technology not having an impulse effect based on the multiplied data enable signal XDE.

The periodic signal generating unit 147 generates an inverse periodic signal Tinv, which is inverted every predetermined time interval, depending on the periodic data Dt to supply the inverse periodic signal Tinv to the XOR circuit 148. The XOR circuit 148 performs an XOR operation on the polarity control signal POL and the inverse periodic signal Tinv to output the inverse polarity control signal POL_INV.

Figure 15:
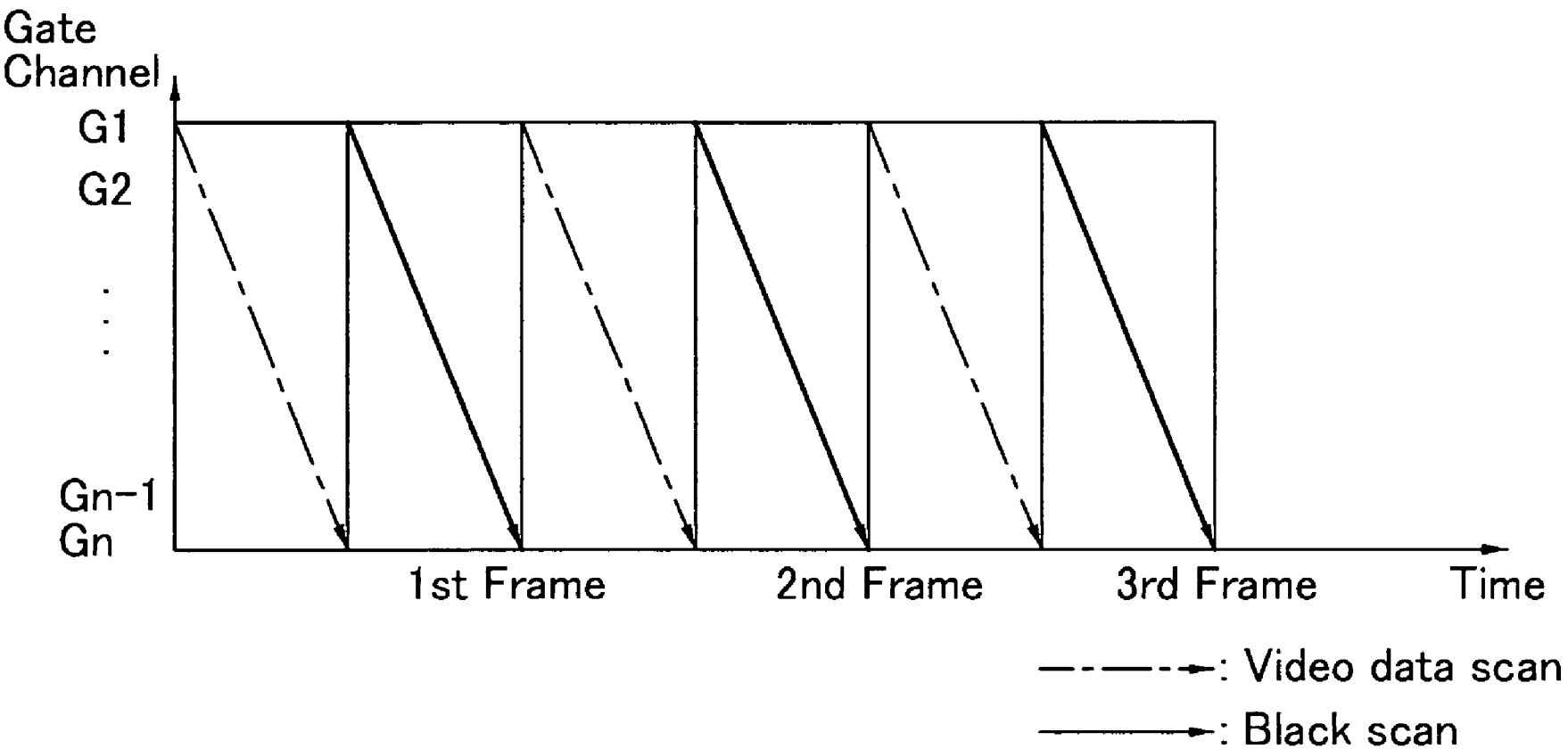
FIGS. 15 and 16 illustrate an exemplary scanning operation of video data and black data in the liquid crystal display according to the second exemplary embodiment.
Figure 16:
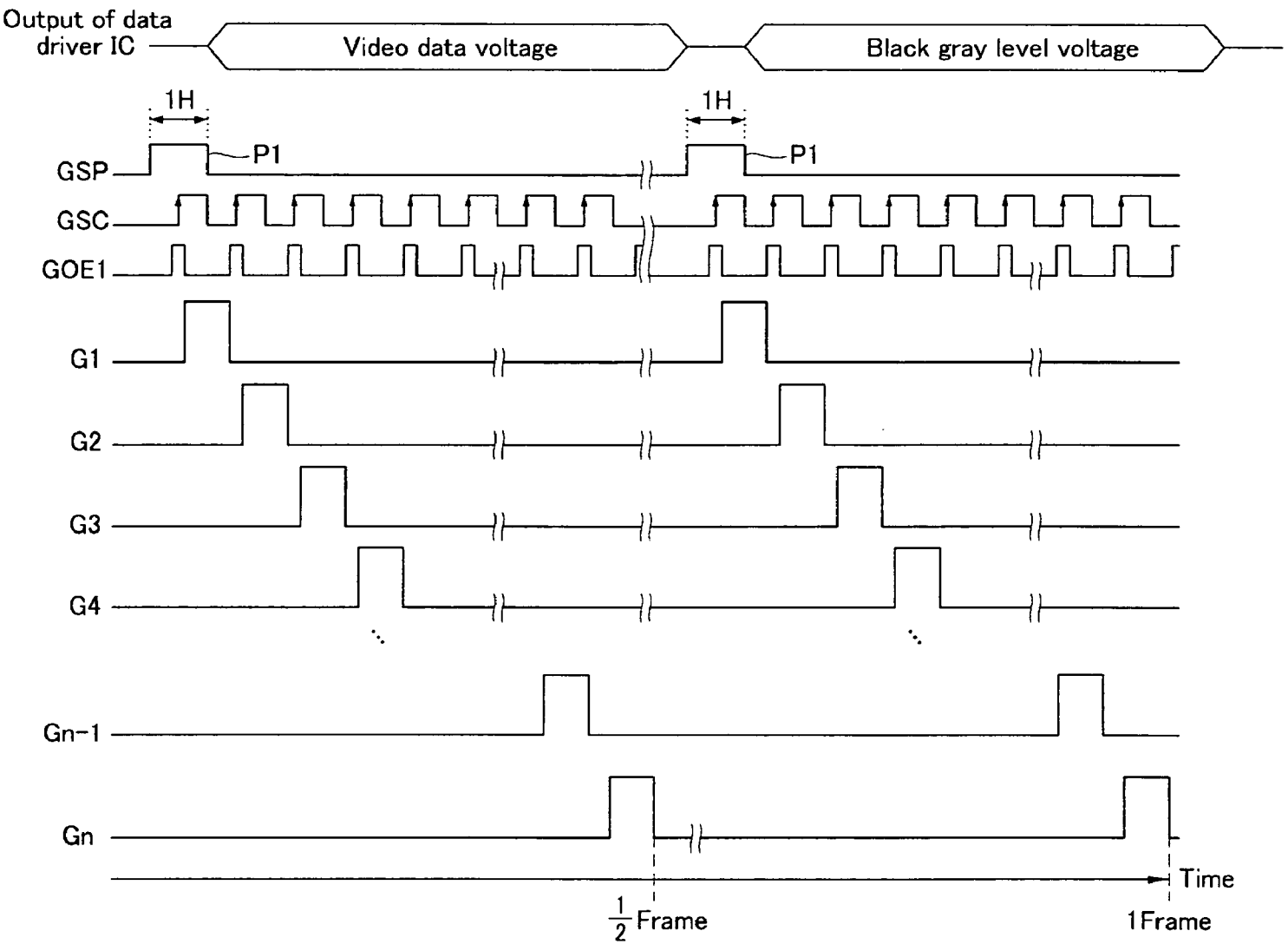

The liquid crystal display according to the second exemplary embodiment is driven at a frame frequency of 120 Hz. As shown in FIGS. 15 and 16, after the gate start pulse GSP is once generated as soon as 1 frame period starts, the gate start pulse GSP is again generated once after the passage of one half of the 1 frame period. As a result, all the liquid crystal cells of the liquid crystal display panel 130 are charged to the video data voltage during a first half period corresponding to one half of 1 frame period, and then are charged to the black gray level voltage during a second half period corresponding to the other half. Hence, the liquid crystal display according to the second exemplary embodiment is impulse driven.

In FIG. 16, G1 to Gn indicate the gate pulses, and 1H indicates 1 horizontal period. A length of the 1 horizontal period is about one half of a length of 1 horizontal period of the data enable signal DE input to the timing controller 131.

The liquid crystal display according to the second exemplary embodiment periodically inverts a polarity of the black gray level voltage using the inverse polarity control signal POL_INV to periodically invert a motion direction of liquid crystal molecules. As a result, the liquid crystal display according to the second exemplary embodiment can be impulse driven by charging the liquid crystal cells to the video data voltage and then charging the liquid crystal cells to the black gray level voltage, and also can minimize the polarization and accumulation of ions in the liquid crystal layer by periodically inverting the motion direction of the liquid crystal molecules to thereby prevent stain appearance.

Figure 17:
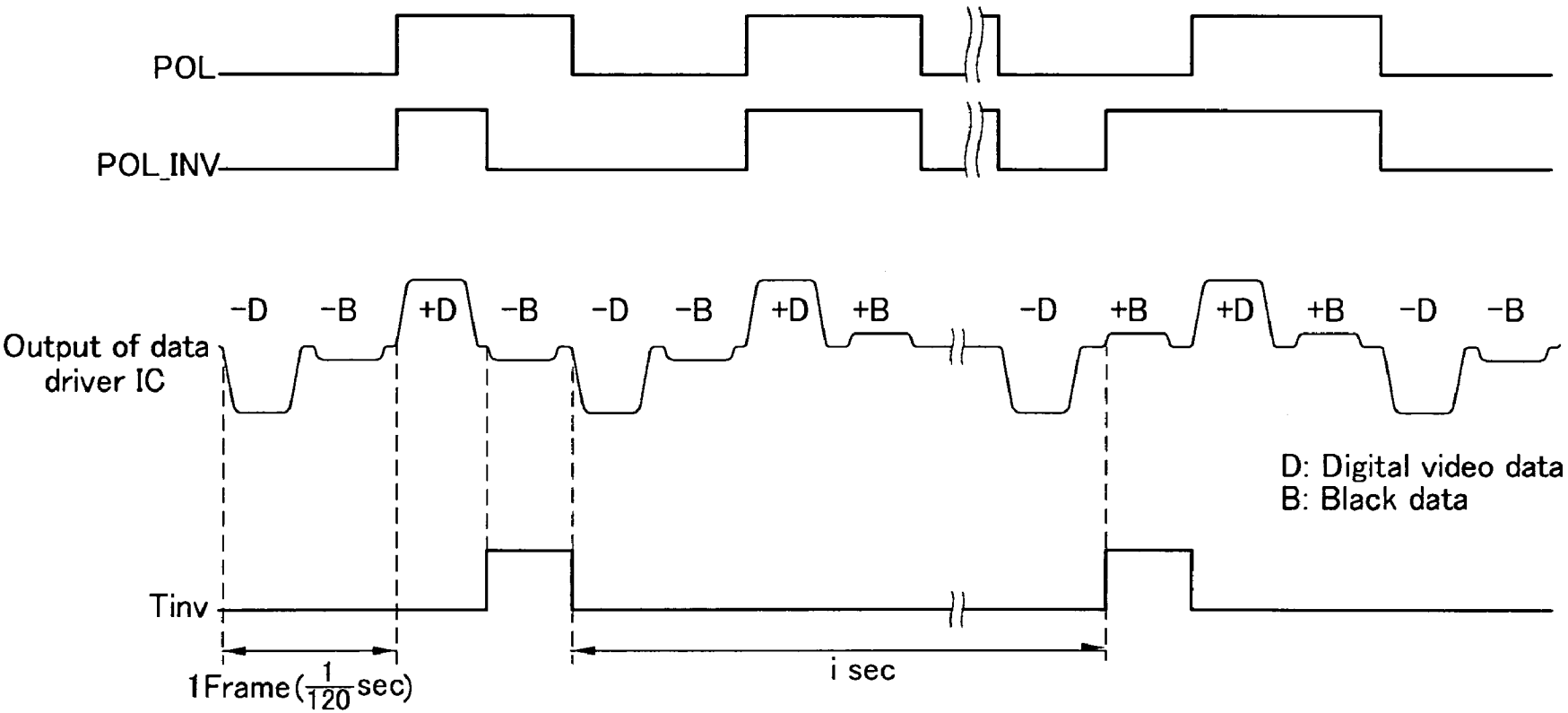
FIGS. 17 to 19 are diagrams showing waveforms of a polarity control signal, an inverse polarity control signal, and an inverse periodic signal and positive and negative analog video data voltages and positive and negative black gray level voltages applied to the liquid crystal display according to the second exemplary embodiment.
Figure 18:
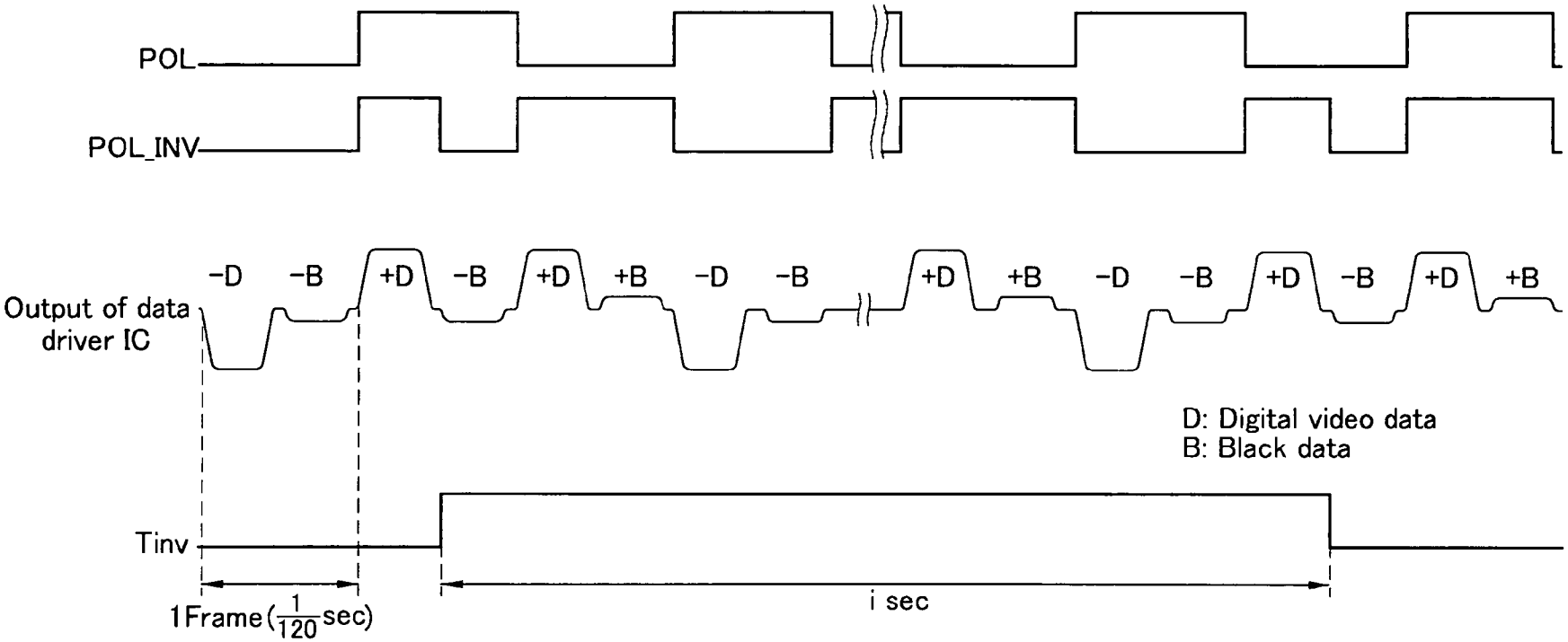
Figure 19:
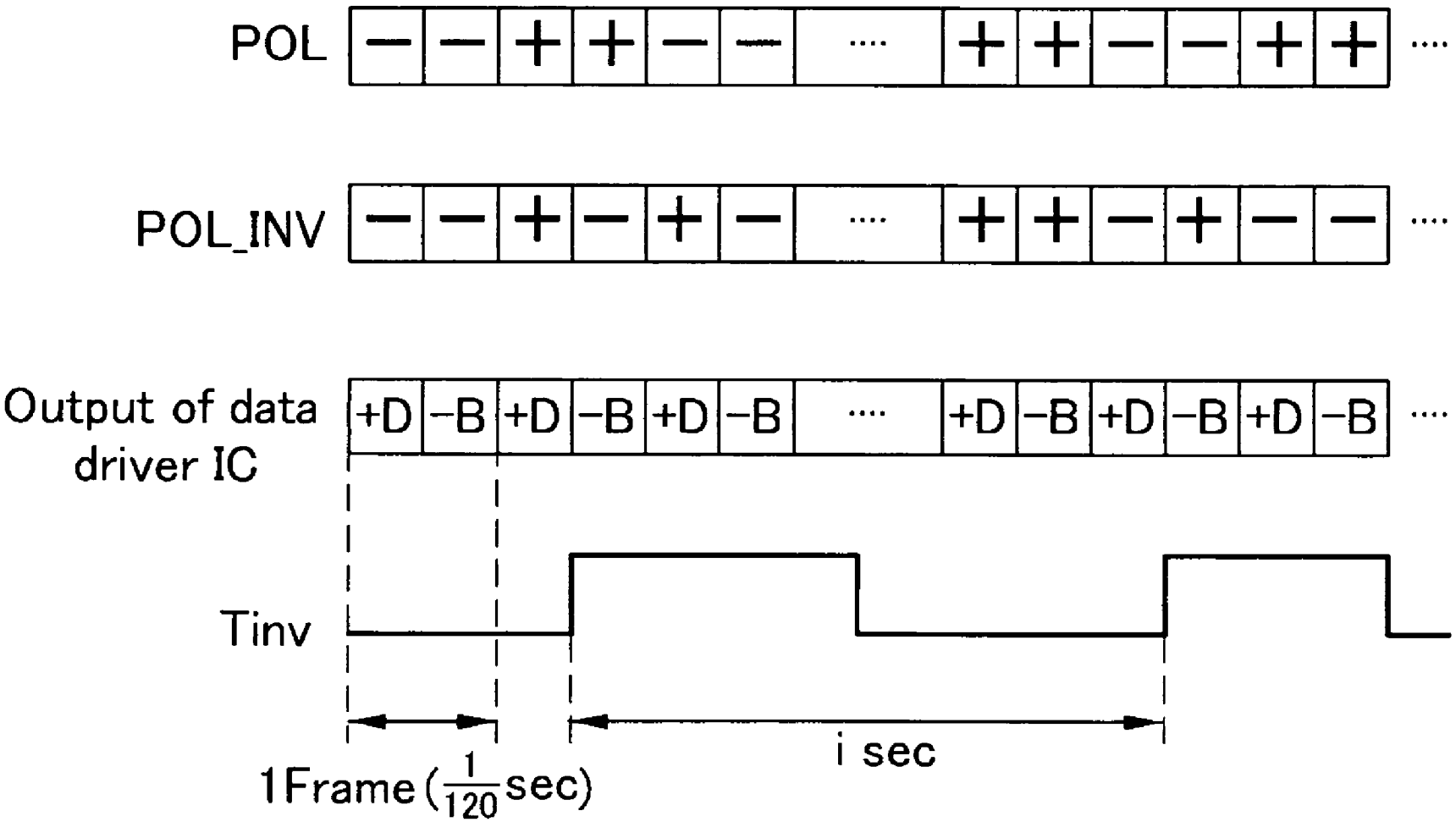

FIGS. 17 to 19 illustrate an inverse period of the inverse polarity control signal POL_INV. More specifically, FIGS. 17 to 19 illustrate waveforms of the polarity control signal POL, the inverse polarity control signal POL_INV, and the inverse periodic signal Tinv and positive and negative analog video data voltages +D and −D and positive and negative black gray level voltages +B and −B controlled by the inverse polarity control signal POL_INV in the liquid crystal display according to the second exemplary embodiment. In FIGS. 17 to 19, the positive and negative analog video data voltages +D and −D and the positive and negative black gray level voltages +B and −B are voltages to which the same liquid crystal cell is charged.

As shown in FIG. 17, the inverse periodic signal Tinv includes pulses generated every "i" sec, where "i" is an integer larger than 2. Each pulse of the inverse periodic signal Tinv is synchronized with the black gray level voltage received from the data driver IC. The polarity control signal POL is generated in the substantially same form as a related art polarity control signal. A phase of the polarity control signal POL is periodically inverted so that a polarity of the video data voltage and a polarity of the black gray level voltage, to which the same liquid crystal cell will be charged, are equal to each other during 1 frame period.

The liquid crystal cells are successively charged to the video data voltage and the black gray level voltage, whose the polarities are controlled depending on the inverse polarity control signal POL_INV, during 1 frame period (1/120 sec). The XOR circuit 148 inverts the polarity control signal POL to generate the inverse polarity control signal POL_INV every time the pulses of the inverse periodic signal Tinv synchronized with the black gray level voltage are input. Accordingly, every time the pulses of the inverse periodic signal Tinv are input, the liquid crystal cells are charged to the black gray level voltage, whose the polarity is opposite to the polarity of the video data voltage charged prior to the black gray level voltage during 1 frame period. While the inverse periodic signal Tinv is hold at a low logic level, the liquid crystal cells are charged to the black gray level voltage, whose the polarity is the same as the polarity of the video data voltage charged prior to the black gray level voltage.

Accordingly, every time the liquid crystal cells are charged to the black gray level voltage at a time interval corresponding to a width of the pulse of the inverse periodic signal Tinv, the liquid crystal molecules and the ions of the liquid crystal cells move in the opposite direction and are not polarized. As a result, the ions in the liquid crystal layer are not divided depending on polarities of the ions and are not dividedly accumulated.

As shown in FIG. 18, the inverse periodic signal Tinv includes pulses that are generated every 2i sec and have a width of "i" sec. In the inverse periodic signal Tinv, a rising edge of the pulse is synchronized with the black gray level voltage, and a falling edge of the pulse is synchronized with the black gray level voltage generated after the passage of "i" sec from the rising edge. The polarity control signal POL is generated in the substantially same form as the related art polarity control signal. A phase of the polarity control signal POL is periodically inverted so that a polarity of the video data voltage and a polarity of the black gray level voltage, to which the same liquid crystal cell will be charged, are equal to each other during 1 frame period.

The liquid crystal cells are successively charged to the video data voltage and the black gray level voltage, whose the polarities are controlled depending on the inverse polarity control signal POL_INV, during 1 frame period (1/120 sec). The XOR circuit 148 inverts the polarity control signal POL for "i" sec, when the pulse of the inverse periodic signal Tinv synchronized with the black gray level voltage is input, to generate the inverse polarity control signal POL_INV. Accordingly, while the pulse of the inverse periodic signal Tinv is input, the liquid crystal cells are charged to the video data voltage and the black gray level voltage, whose polarity patterns are opposite to polarity patterns of the video data voltage and the black gray level voltage charged during for "i" sec prior to the "i" sec. Because ions in the liquid crystal layer periodically move in the opposite direction, the polarization and accumulation of ions are suppressed.

As shown in FIG. 19, the inverse periodic signal Tinv includes pulses that are generated every "i" sec and have a width of i/2 sec. In the inverse periodic signal Tinv, a rising edge of the pulse is synchronized with the black gray level voltage, and a falling edge of the pulse is synchronized with the black gray level voltage or the video data voltage generated after the passage of "i/2" sec from the rising edge. The polarity control signal POL is generated in the substantially same form as the related art polarity control signal. A phase of the polarity control signal POL is periodically inverted so that a polarity of the video data voltage and a polarity of the black gray level voltage, to which the same liquid crystal cell will be charged, are equal to each other during 1 frame period.

The liquid crystal cells are successively charged to the video data voltage and the black gray level voltage, whose the polarities are controlled depending on the inverse polarity control signal POL_INV, during 1 frame period (1/75 sec). The XOR circuit 148 inverts the polarity control signal POL for "i/2" sec, when the pulse of the inverse periodic signal Tinv synchronized with the black gray level voltage is input, to generate the inverse polarity control signal POL_INV. Accordingly, while the pulse of the inverse periodic signal Tinv is input, the liquid crystal cells are charged to the video data voltage and the black gray level voltage, whose polarity patterns are opposite to polarity patterns of the video data voltage and the black gray level voltage charged during for "i/2" sec prior to the "i/2" sec. Because ions in the liquid crystal layer periodically move in the opposite direction, the polarization and accumulation of ions are suppressed.

As can be seen from FIGS. 17 to 19, the timing controller 131 inverts the inverse polarity control signal POL_INV in response to the inverse periodic signal Tinv and allows the polarity of the black gray level voltage to be periodically opposite to the polarity of the video data voltage. Further, the timing controller 131 allows the polarity of the black gray level voltage to be equal to the polarity of the video data voltage during a period except a period directed by the inverse periodic signal Tinv.

As described above, the liquid crystal display and the method of driving the same according to the exemplary embodiments can be impulse driven by charging the liquid crystal cells to the video data voltage and by charging the liquid crystal cells to the black gray level voltage, and also can suppress staining phenomenon by periodically inverting the motion direction of ions in the liquid crystal layer to thereby prevent stain appearance.

It will be apparent to those skilled in the art that various modifications and variations can be made in the embodiments without departing from the spirit or scope of the invention. Thus, it is intended that embodiments of the invention cover the modifications and variations of this invention provided they come within the scope of the appended claims and their equivalents.

What is claimed is:

1. A liquid crystal display comprising:

a liquid crystal display panel including a plurality of liquid crystal cells arranged at crossings of a plurality of data lines and a plurality of gate lines in a matrix format;

a timing signal multiplying circuit that multiplies a frequency of a timing signal;

a timing control signal generating circuit that generates a polarity control signal based on the timing signal of which the frequency is multiplied by the timing signal multiplying circuit, a phase of the polarity control signal being periodically inverted;

a polarity control signal inverting circuit that inverts the polarity control signal in response to pulses of an inverse periodic signal to generate an inverse polarity control signal, the inverse periodic signal being inverted every constant time interval;

a data drive circuit that respectively converts digital video data and digital black data into a video data voltage and a black gray level voltage, inverts a polarity of the video data voltage and a polarity of the black gray level voltage in response to the inverse polarity control signal, and supplies the video data voltage and the black gray level voltage, whose the polarities are inverted, to the data lines; and a gate drive circuit that supplies gate pulses to the gate lines.

2. The liquid crystal display of claim 1, wherein each of the pulses of the inverse periodic signal is synchronized with the black gray level voltage.

3. The liquid crystal display of claim 1, wherein a rising edge and a falling edge of the inverse periodic signal are synchronized with the black gray level voltage.

4. The liquid crystal display of claim 1, further comprising:

a memory controller that generates a write address signal based on the timing signal, generates a read address signal based on the multiplied timing signal, and controls a memory storing the digital video data;

a multiplexer that selects the digital black data and the digital video data stored in the memory under the control of the timing signal multiplying circuit;

an interface circuit that supplies the digital black data and the digital video data selected by the multiplexer to the data drive circuit; and a periodic signal generating unit that generates the inverse periodic signal depending on periodic data received from the outside, wherein the polarity control signal inverting circuit includes an exclusive OR (XOR) circuit that performs an XOR operation on the polarity control signal and the inverse periodic signal to generate the inverse polarity control signal.

5. A method of driving a liquid crystal display including a liquid crystal display panel, that includes a plurality of liquid crystal cells arranged at crossings of a plurality of data lines and a plurality of gate lines in a matrix format, the method comprising:

multiplying a frequency of a timing signal;

generating a polarity control signal based on the multiplied timing signal, a phase of the polarity control signal being periodically inverted;

inverting the polarity control signal in response to pulses of an inverse periodic signal to generate an inverse polarity control signal, the inverse periodic signal being inverted every constant time interval;

respectively converting digital video data and digital black data into a video data voltage and a black gray level voltage, inverting a polarity of the video data voltage and a polarity of the black gray level voltage in response to the inverse polarity control signal, and supplying the video data voltage and the black gray level voltage, whose the polarities are inverted, to the data lines; and supplying gate pulses to the gate lines.

6. The method of claim 5, wherein each of the pulses of the inverse periodic signal is synchronized with the black gray level voltage.

7. The method of claim 5, wherein a rising edge and a falling edge of the inverse periodic signal are synchronized with the black gray level voltage.

* * * * *